US006258524B1

(12) United States Patent
Hirabayashi et al.

(10) Patent No.: US 6,258,524 B1
(45) Date of Patent: Jul. 10, 2001

(54) THERMALLY DEVELOPABLE MATERIAL

(75) Inventors: Kazuhiko Hirabayashi; Takeshi Sampei; Kenji Goto, all of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/421,369

(22) Filed: Oct. 19, 1999

(30) Foreign Application Priority Data

Oct. 20, 1998 (JP) ..... 10-298388
Nov. 13, 1998 (JP) ..... 10-323549

(51) Int. Cl.[7] ..... G03C 1/498
(52) U.S. Cl. ..... 430/619; 430/531; 430/617
(58) Field of Search ..... 430/617, 619, 430/264, 531

(56) References Cited

U.S. PATENT DOCUMENTS 3,816,122 6/1974 Hamb .
5,001,033 * 3/1991 Takeno et al. ..... 430/203
5,223,384 * 6/1993 Ohbayashi et al. ..... 430/538
5,945,263 * 8/1999 Deroover et al. ..... 430/619

FOREIGN PATENT DOCUMENTS 0 803 766 A1 10/1997 (EP) .

* cited by examiner

*Primary Examiner*—Thorl Chea
(74) *Attorney, Agent, or Firm*—Finnegan, Henderson, Farabow, Garrett, & Dunner L.L.P.

(57) ABSTRACT

A thermally developable material comprising a support, an image forming layer containing an organic silver salt, and a component layer provided on the same side as said image forming layer provided,
wherein the stiffness (ST) of said thermally developable material under conditions of 23° C. and 50% RH is 30 g≦ST≦80 g.

12 Claims, No Drawings

THERMALLY DEVELOPABLE MATERIAL

FIELD OF THE INVENTION

The present invention relates to a thermally developable material, and specifically relate to a thermally developable photosensitive material which is suitable for producing an excellent dot image employing a laser image setter.

BACKGROUND OF THE INVENTION

Conventionally, in the graphic art field, processing solution waste generated along with the wet process for image forming materials has caused problems regarding workability, and in recent years, a decrease in the processing solution waste has been strongly demanded in terms of ecological concerns and space savings. Thus, a technique for a light heat photographic material for technical photographic use is sought in which exposure can be effectively carried out using a laser image setter, and development by no use of processing solution, is possible, so that sharp and bright images with high resolution can be attained.

Methods for such techniques are well known and which are described, for example, in U.S. Pat. Nos. 3,152,904 and 3,487,075, and in D. Morgan, "Dry Silver Photographic Materials" (Handbook of Imaging Materials, Marcel Dekker, Inc. page 48, 1991), etc.

Said thermally developable photosensitive material comprises a reducible silver source (organic silver salt), a light catalyzer with a catalytically active amount, and a reducing agent which are generally dispersed into a (organic) binder matrix. The thermally developable photosensitive material is stable at normal temperatures and is developed, after exposure, when heated to high temperatures. Upon heating, silver is formed through an oxidation-reduction reaction between the organic silver salt (functioning as an oxidizing agent) and the reducing agent. This oxidation-reduction reaction is accelerated by the catalytic action of a latent image formed in the silver halide through exposure. Silver formed by the reaction with the organic silver salt in an exposed area yields a black image, which contrasts with unexposed areas to form a visual image.

In order for the thermally developable photosensitive material to be effectively exposed to produce an excellent dot image, a photosensitive material, by which a high contrast image can be obtained, is necessary. A conventional silver halide photosensitive material contains a hydrazine derivative as a high contrast enhancement agent, and it is well known that the above-mentioned thermally developable photosensitive material also contains a hydrazine derivative as described in U.S. Pat. Nos. 5,545,505 and 5,464,738.

SUMMARY OF THE INVENTION

When said thermally developable material is processed with an exposing apparatus and an automatic processor, transportation problems of said thermally developable material tend to occur. Said transportation problems are often caused by small protrusions which are formed by adhered matters on the transportation rollers, so that said thermally developable photosensitive material tends to get out the transportation system, or said thermally developable photosensitive material is itself wound around the transportation rollers. After efforts of the present inventive employees to overcome the above-mentioned problems, it was found that these problems were often attributed to the softening of a support of the thermally developable material, because said thermally developable material is developed at an extremely high temperature, at which a conventional silver halide photographic light-sensitive material is not developed. Because of the above-mentioned reason, many transportation failures occur in processing said thermally developable material.

To overcome the above-detailed problems, some auxiliary guides are provided between the transportation rollers to regulate the transportation pathway. However, with said guides, abrasion marks (black abrasions) on the thermally developable material can not be avoided, and specifically, in the case of the thermally developable photosensitive material containing a high contrast enhancement agent such as hydrazine derivative, the black abrasions are marked and unacceptable for practical use. Further, when said thermally developable material contains said high contrast enhancement agent, fogging due to the transportation rollers, a so-called roller mark, is marked.

Furthermore, in the case of a laser image setter in which an exposing apparatus and an thermal developer are integrated, said transportation problems readily tend to occur because transportation pathway is very long.

In the foregoing statements, the present invention was accomplished. An object of the present invention is to provide a thermally developable material with excellent transportation capability, when said thermally developable material is processed at a high temperature. The second object of the present invention is to provide a thermally developable material without transportation problems, when said thermally developable material is processed with a laser image setter in which an exposing apparatus and an automatic developer are integrated. The third object of the present invention is to provide a thermally developable material suitable for forming a dot image employing said laser image setter.

Furthermore, with a conventional thermally developable material, the following problems other than the above-mentioned problems are cited. When a thermally developable material is applied for the use of the graphic art field, since many sheets of the thermally developable material are needed, a wide thermally developable material in roll form is practically used, therefore, said wide thermally developable material in roll form is cut to predetermined sizes in an exposing apparatus (generally, in a plotter or a laser image setter, and the plotter being the generic term for said exposing apparatus). However, since the thickness of the photosensitive layer side of said roll type thermally developable photosensitive material is rather thick, cutter failures, in the cutting of said roll type thermally developable photosensitive material in said plotter, occur frequently. Therefore, in the foregoing statements, an additional object of the present is to provide the prevention of said cutter failures.

DETAILED DESCRIPTION OF THE INVENTION

The above-mentioned objects are attained by the following constitution.

[Item 1] A thermally developable material comprising a support, an image forming layer containing an organic silver salt, and a component layer provided on the same side as said image forming layer provided, wherein the stiffness (ST) of said thermally developable material under conditions of 23° C. and 50% RH is 30 g≦ST≦80 g.

[Item 2] The thermally developable material of item 1, wherein said image forming layer or said component layer contains a reducing agent or a precursor of said reducing agent.

[Item 3] The thermally developable material of item 1, wherein said image forming layer contains silver halide grains, and said thermally developable material is a thermally developable photosensitive material.

[Item 4] The thermally developable material of item 1, wherein said thermally developable material contains a hydrazine derivatives.

[Item 5] The thermally developable material of item 1, wherein the breaking stress of said thermally developable material is from 10 to 30 kgf/mm$^2$.

[Item 6] The thermally developable material of item 1, wherein the breaking elogation of said thermally developable material is from 100 to 300%.

[Item 7] The thermally developable material of item 1, wherein the Young's modulus of said thermally developable material is from 300 to 600 kgf/mm$^2$.

[Item 8] The thermally developable material of item 1, wherein said thermally developable material is a roll type thermally developable material.

[Item 9] The thermally developable material of item 1, wherein said thermally developable material contains a polymer latex of which glass transition temperature is lower than 50° C.

[Item 10] The thermally developable material of item 1, wherein the thickness of said support is form 50 to 300 $\mu$m.

[Item 11] The thermally developable material of item 1, wherein the thickness of said support is form 70 to 180 $\mu$m.

[Item 12] The thermally developable material of item 1, wherein the thickness of said support is form 110 to 140 $\mu$m.

[Item 13] The thermally developable material of item 1, wherein the glass transition temperature of said support is from 50° C. to 70° C.

In the present invention, the following items are also important.

(1) A thermally developable photosensitive material comprising a support having thereon an organic silver salt and a photosensitive silver halide,
wherein the stiffness (ST) of said thermally developable photosensitive material under conditions of 23° C. and 50% RH is 30 g$\leqq$ST$\leqq$80 g.

(2) A roll type thermally developable photosensitive material comprising a photosensitive silver halide, an organic silver salt, a reducing agent and a binder,
wherein the breaking stress of said roll type thermally developable photosensitive material is from 10 to 30 kgf/mm$^2$.

(3) A roll type thermally developable photosensitive material comprising a photosensitive silver halide, an organic silver salt, a reducing agent and a binder,
wherein the breaking elongation of said roll type thermally developable photosensitive material is from 100 to 300%.

(4) A roll type thermally developable photosensitive material comprising a photosensitive silver halide, an organic silver salt, a reducing agent and a binder,
wherein the Young's modulus of said roll type thermally developable photosensitive material is from 300 to 600 kgf/mm$^2$.

The present invention will now be detailed below.

A thermally developable material of the present invention comprises a support, an image forming layer containing an organic silver salt, and a component layer provided on the same side as said image forming layer coated on said support, wherein the stiffness (ST) of said thermally developable material is regulated to satisfy the following relationship; 30 g$\leqq$ST$\leqq$80 g.

Further, the length of said thermally developable material in the length direction is preferably from 600 mm to 65 m, and said thermally developable material is preferably in roll form. Furthermore, the breaking stress of said thermally developable material is preferably from 10 to 30 kgf/mm$^2$, and the breaking elongation of said thermally developable material is from 100 to 300%, and further, the Young's modulus of said thermally developable material is from 300 to 600 kgf/mm$^2$.

Furthermore, the stiffness (ST) of the thermally developable material is measured according to the following procedure. 10×20 cm size sheet samples are left undisturbed at 23° C., 50% RH over a period of 2 hours. The stiffness (ST) is measured employing a film stiffness tester (e.g. UT-200GR produced by Toyo Seiki Co.). Five cm of both ends of said 10×20 cm size sheet sample were fixed onto two separately placed clamps, after which the clamps were moved toward each other, so that center 10 cm area was buckled and raised to 1 cm from the original surface. After that, a weighted needle is placed on the top of said buckled center area of the sample, and the weight, which causes the top to be lowered by 3 mm, is noted. Said weight is used for evaluation of the stiffness of the photosensitive material.

In the present invention, in order to determine the breaking stress, the breaking elongation, and the Young's modulus, 1×15 cm size samples are left undisturbed at 23° C., 48% RH over a period of 2 hours, and each of the breaking stress, the breaking elongation, as well as the Young's modulus of the thus treated samples are measured 5 times employing a tensile tester (for example, TENSILON produced by Olyntech Co.), after which an average value is evaluated from said 5 measurements.

An image forming layer or a component layer of the thermally developable material of the present invention preferably incorporates a reducing agent or a precursor of the reducing agent. Further, it is preferable that said image forming layer contains photosensitive silver halide grains, and in addition, said thermally developable material is a thermally developable photosensitive material. Hereinafter, said image forming layer containing photosensitive silver halide grains is occasionally referred to as a photosensitive layer.

Further, the thermally developable material preferably contains a high contrast accelerating agent such as a hydrazine derivative, and said high contrast accelerating agent such as the hydrazine derivative is preferably incorporated in an image forming layer such as a photosensitive layer or a component layer adjacent to said image forming layer.

Said thermally developable material of the present invention is stable at normal temperatures and is developed, after exposure, when heated to higher temperatures. Upon heating, silver is formed through an oxidation-reduction reaction between the organic silver salt (functioning as an oxidizing agent) and the reducing agent. This reaction process proceeds without the further supply of any processing solution such as water, etc. from outside. Heating temperature (thermal development temperature) is preferably between 80 and 200° C., and is more preferably between 100 and 150° C. In order to obtain a stable image density, said thermally developable material may be preheated at 5° C. or more lower than developing temperature just before thermal development. Time necessary for the thermal development is preferably between 10 and 60 sec. and time necessary for the preheating is preferably between 5 and 60 sec.

The thermally developable material is processed, by passing said thermally developable material through a heat insulating chamber, having a heat element, in which a heat drum of which diameter is not less than 200 mm and a transportation belt placed opposite to said drum are provided, or by passing said thermally developable material through an apparatus in which plural transportation auxiliary rollers having a diameter of 10 to 50 mm are provided along by said heat drum so that the image forming layer side is contacted with said heat drum, and in addition, by passing said thermally developable material through a heat insulating chamber, heated by a heat element, in which plural transportation rollers are placed in zigzag state or face-to-face state, capable of transporting said thermally developable material straightly, further in addition, by passing said thermally developable material through an apparatus in which rollers themselves having heat elements are provided.

The component layer according to the present invention is a layer other than the image forming layer. Examples of said component layer include a protective layer protecting the image forming layer (usually, a layer being provided on an outermost layer), a sublayer, an adhesion layer provided between the sublayer and the image forming layer or an antihalation layer. Plural image forming layers and plural sublayers may be employed.

The thickness of the image forming layer such as the photosensitive layer is preferably between 1 and 20 $\mu$m, and is more preferably 1.5 and 10 $\mu$m.

The aforesaid thermally developable photosensitive material, to which the processing method of the present invention is applied, is one comprised of an organic silver salt, photosensitive silver halide grains and a reducing agent. Of these, silver halide grains function as a light sensor. In the present invention, in order to minimize the translucence after image formation and to obtain excellent image quality, the average grain size is preferably minimal. The average grain size is preferably not more than 0.1 $\mu$m; is more preferably between 0.01 and 0.1 $\mu$m, and is most preferably between 0.02 and 0.08 $\mu$m. The average grain size as described herein implies the ridge line length of a silver halide grain, when it is a so-called regular crystal which is either cubic or octahedral. When the grain is not a regular crystal, for example, when it is a spherical, cylindrical, or tabular grain, the grain size is given as the diameter of a sphere having the same volume as each of those grains.

Furthermore, the silver halide is preferably monodispersed. Said monodisperse as described herein means that the degree of monodispersibility obtained by the formula described below is not more than 40 percent. The more preferred grains are those which exhibit a degree of monodispersibility of not more than 30 percent, and the particularly preferred grains are those which exhibit a degree of monodispersibility which is between 0.1 and 20 percent.

Degree of monodispersibility=(standard deviation of grain diameter)/(average of grain diameter)×100

There is no particular limitation to the silver halide grain shape. However, a high ratio of Miller index [100] planes is preferred. This ratio is preferably at least 50 percent; is more preferably at least 70 percent, and is most preferably at least 80 percent. The ratio of the Miller index [100] planes can be obtained based on T. Tani, J. Imaging Sci., 29, 165 (1985) in which adsorption dependency of a [111] plane and a [100] plane is discussed.

Further, another preferred silver halide shape is a tabular grain. The tabular grain as described herein is preferably a grain having an average aspect ratio of 2 to 100 and more preferably 3 to 50 with the grain diameter being preferably not more than 0.1 $\mu$m, and more preferably between 0.01 and 0.08 $\mu$m. These characteristics are described in U.S. Pat. Nos. 5,264,337, 5,314,789, 5,320,958, and others, by which any desired tabular grains can readily be prepared.

The composition of silver halide is not particularly limited and may be any of several common ones, such as silver chloride, silver chlorobromide, silver chloroiodobromide, silver bromide, silver iodobromide, or silver iodide.

The photographic emulsion employed in the present invention can be prepared employing methods described in P. Glafkides, "Chimie et Physique Photographique" (published by Paul Montel, 1967), G. F. Duffin, "Photographic Emulsion Chemistry" (published by The Focal Press, 1966), V. L. Zelikman et al., "Making and Coating Photographic Emulsion" (published by The Focal Press, 1964), etc.

The resulting silver halide may be incorporated into an image forming layer utilizing any practical method, at which, silver halide is placed adjacent to a reducible silver source.

Furthermore, silver halide may be prepared by converting a part or all of the silver in an organic silver salt formed through the reaction of an organic silver salt with halogen ions into silver halide. Silver halide may be prepared previously and the resulting silver halide may be added to a solution to prepare the organic silver salt, or combinations thereof may be used, however the latter are preferred.

Generally, the content of silver halide in organic silver salt is preferably between 0.75 and 30 weight percent.

Silver halide employed in the present invention is preferably comprised of metal ions, in transition metals belonging to Groups 6 through 11 of the Periodic Table. As the above-mentioned metals, preferred are Cr, W, Fe, Co, Ni, Cu, Ru, Rh, Pd, Re, Os, Ir, Pt or Au.

Generally, the content of these metal ions is suitably between $1\times10^{-9}$ and $1\times10^{-2}$ mole per mole of silver halide, and is preferably between $1\times10^{-8}$ and $1\times10^{-4}$ mole.

The photosensitive silver halide grains may be desalted by employing any of the well known desalting methods in this art, such as the noodle method, flocculation method, ultrafiltration method, or electrodianalysis method, etc.

The photosensitive silver halide grains used in the present invention are preferably subjected to chemical sensitization. As preferable chemical sensitizations, any of the well known chemical sensitizations in this art may be used, such as a sulfur sensitization, a selenium sensitization and a tellurium sensitization, a noble metal sensitization, or a reduction sensitization, etc. Combined usage of two or more kinds of the above-mentioned sensitization may be employed. As compounds preferably used in the sulfur sensitization, sodium sulfate, thiourea compound, inorganic sulfur and the like are cited. As compounds preferably used in the selenium sensitization and the tellurium sensitization, are compounds described in Japanese Patent Publication Open to Public Inspection (hereinafter referred to as JP-A) No. 9-230527. Examples of compounds used in the noble metal sensitization include chloroauric acid, potassium chloroaurate, potassium aurithiocyanate, gold sulfide, gold selenide, being compounds described in U.S. Pat. No. 2,448,060 and British Patent No. 618,061. Examples of compounds used in the reduction sensitization include ascorbic acid, thiourea dioxide, stannous chloride, hydrazine derivatives, borane compounds, silane compounds and polyamine compounds. The reduction sensitization can be carried out by ripening an emulsion, the pH and pAg of which are kept to not less than 7 and not more than 8.3 respectively. Furthermore, the reduction sensitization can be carried out by introducing a single addition part of silver ion during the grains being formed.

Organic silver salts are reducible silver sources and preferred are silver salts of organic acids and hetero-organic acids having a reducible silver ion source, specifically, long chain aliphatic carboxylic acids (having from 10 to 30 carbon atoms, but preferably from 15 to 25 carbon atoms) and nitrogen-containing heterocylic rings.

Organic or inorganic silver salt complexes are also useful in which the ligand has a total stability constant for silver ion of 4.0 to 10.0. Examples of preferred silver salts are described in Research Disclosure (abbreviated as RD), Items 17029 and 29963, and include the following; organic acid silver salts (for example, salts of gallic acid, oxalic acid, behenic acid, arachidinic acid, stearic acid, palmitic acid, lauric acid, oleic acid, caproic acid, myristic acid, palmitic acid, maleic acid, linoleic acid, etc.); carboxyalkylthiourea silver salts [for example, salts of 1-(3-carboxypropyl) thiourea, 1-(3-carboxypropyl)-3,3-dimethylthiourea, etc.]; silver salts or complexes of polymer reaction products of aldehyde with hydroxy-substituted aromatic carboxylic acid [for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid], silver salts or complexes of thioenes [for example, 3-(2-carboxyethyl)-4-hydroxymethyl-4- (thiazoline-2-thioene and 3-carboxymethyl-4-thiazoline-2-thioene, and 3-carboxymethyl-4-thiazoline-2-thioene, etc.)], complexes of silver with nitrogen acid selected from imidazole, pyrazole, urazole, 1.2,4-thiazole, 1H-tetrazole, 3-amino-5-benzylthio-1,2,4-triazole or benztriazole or salts thereof; silver salts of saccharin, 5-chlorosalicylaldoxime, etc.; and silver salts of mercaptides. Of these, the preferred silver salts are silver behenate, silver arachidinate and silver stearate.

Organic silver salts can be prepared by mixing a water-soluble silver compound with a compound which forms a complex with silver, and preferably employed are methods known as normal precipitation, reverse precipitation, double-jet precipitation, or controlled double-jet precipitation, as described in JP-A No. 9-127643, etc. For example, after an organic alkali metal salt soap (e.g., sodium behenate, sodium arachidinate, etc.) is prepared by adding an organic acid to an alkali metal salt (e.g., sodium hydroxide, potassium hydroxide, etc.), the above-mentioned soap and silver nitrate are mixed to produce crystals of the organic silver salt. Preparing the organic silver salt may be performed in the presence of a silver halide.

Organic silver salts have an average grain diameter of not more than 1 $\mu$m and are preferably monodispersed. The average diameter of the organic silver salt as described herein is, when the grain of the organic salt is, for example, a spherical, a cylindrical, or a tabular grain, the diameter of the sphere having the same volume as each of these grains. The average grain diameter is preferably between 0.01 and 0.8 $\mu$m, but is most preferably between 0.05 and 0.5 $\mu$m. Furthermore, the monodisperse as described herein is the same as silver halide grains and the preferred monodispersibility is between 1 and 30%.

Furthermore, the tabular grains having an aspect ratio of not more than 3 preferably occupy at least 60% of all the organic silver salt.

In order to arrange the shape of the organic silver salts, said organic silver salt crystals may be mixed with a binder or a surfactant to be dispersed and pulverized by employing a ball mill or the like.

In order to prevent devitrification of the thermally developable material, the sum total of silver contained in both the photosensitive silver halide and the organic silver salt is preferably 0.5 to 2.2 g per $m^2$. When silver grains are prepared within this range, high contrast images can be obtained. Ratio of an amount of the photosensitive silver halide to the sum total of silver is preferably not more 50 wt %, more preferably not more 25 wt %, specifically preferably within 0.1 wt % to 15 wt %.

A reducing agent is preferably incorporated into the thermally developable material to which the present invention is applied. Examples of suitable reducing agents are described in U.S. Pat. Nos. 3,770,448, 3,773,512, and 3,593,863, and Research Disclosure Items 17029 and 29963, and include the following. Aminohydroxycycloalkenone compounds (for example, 2-hydroxypiperidino-2-cyclohexane); esters of amino reductones as the precursor of reducing agents (for example, pieridinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl)methylsulfone); sulfhydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; $\alpha$(-cyanophenylacetic acid derivatives; combinations of bis-$\beta$-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols. As hindered phenols, listed are compounds represented by the general formula (A) described below.

General formula (A)

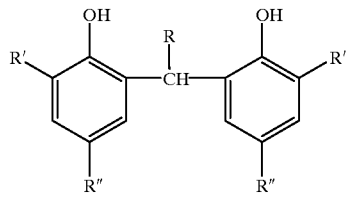

wherein R represents a hydrogen atom or an alkyl group having from 1 to 10 carbon atoms (for example, —$C_4H_9$, 2,4,4-trimethylpentyl), and $R_f$ and $R_l$ each represents an alkyl group having from 1 to 5 carbon atoms (for example, methyl, ethyl, t-butyl).

Specific examples of the compounds represented by the general formula (A) are described below.

A-1

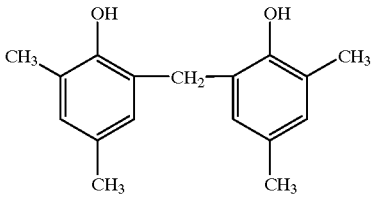

A-2

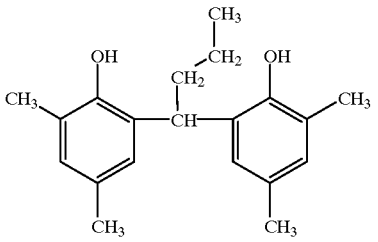

A-3

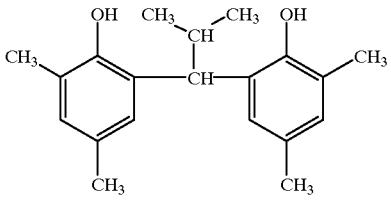

A-4

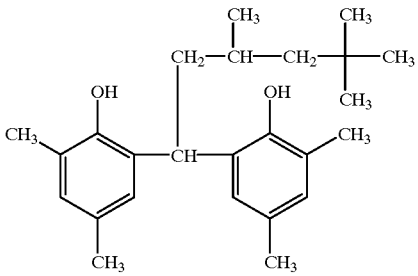

A-5

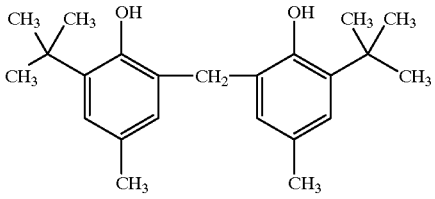

A-6

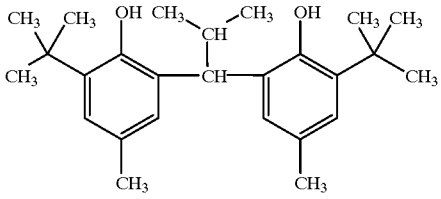

A-7

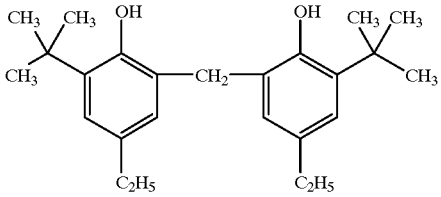

The used amount of reducing agents first represented by the above-mentioned general formula (A) is preferably between $1\times10^{-2}$ and 10 moles per mole of silver, and is most preferably between $1\times10^{-2}$ and 1.5 moles.

Binders suitable for the thermally developable material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly(methylmethacrylic acid), poly(vinyl chloride), poly(methacrylic acid), copoly (styrene-maleic acid anhydride), copoly(styrene-acrylonitrile, copoly(styrene-butadiene, poly(vinyl acetal) series (for example, poly(vinyl formal)and poly(vinyl butyral), poly(ester) series, poly(urethane) series, phenoxy resins, poly(vinylidene chloride), poly(epoxide) series, poly (carbonate) series, poly(vinyl acetate) series, cellulose esters, poly(amide) series. These may be hydrophilic or hydrophobic. Further, Tg of binder contained in the image forming layer is preferably less than 80° C., and is more preferably less than 70° C. In the present invention, in order to minimize fogging after the thermal development, a hydrophobic transparent binder is preferably employed. Examples of preferable binders include polyvinyl butyral, cellulose acetate, cellulose acetate butylate, polyester, polycarbonate, polyacrylic acid, and polyurethane, etc. Of these, polyvinyl butyral, cellulose acetate, cellulose acetate butyrate and polyester are specifically preferred.

From the viewpoint of thermal development rate, the amount of the binder in a photosensitive layer is preferably between 1.5 and 10 g/m$^2$, and is more preferably between 1.7 and 8 g/m$^2$. When the amount is below 1.5 g/m$^2$, the density of an unexposed part markedly increases to occasionally cause no commercial viability.

In order to control the amount or wavelength distribution of light transmitted through the photosensitive layer, dyes or pigments may be incorporated in a protective layer, or a filter layer may be provided on the opposite side to the photosensitive layer, or dyes or pigments may be incorporated in the photosensitive layer. As the usable dyes, those which can absorb aimed wavelength in desired wavelength region can be used, preferred are compounds described in JP-A Nos. 59-6481, 59-182436, U.S. Pat. Nos. 4,271,263, 4,594,312, European Patent Publication Nos. 533,008, 652,473, JP-A Nos. 2-216140, 4-348339, 7-191432, 7-301890 and 8-201959. The photosensitive layer may be composed of a plurality of layers. Furthermore, for gradation adjustment, in terms of sensitivity, layers may be constituted in such a manner as a fast layer/slow layer or a slow layer/fast layer.

Silver image color control agents are preferably incorporated into the thermally developable material for the purpose of improving the silver image color after development. Examples of suitable silver image color control agents are disclosed in Research Disclosure Item 17029. Preferable image color control agents are phthalazine or phthalazone.

In order to accelerate or retard development, or to enhance spectral sensitizing effect, or improve storage stability before or after development, a mercapto compound, a disulfido compound or thione compound may be incorporated in the thermally developable photosensitive material.

Antifoggants may be incorporated into the thermally developable material. The substance which is known as the most effective antifoggant is a mercury ion. The incorporation of mercury compounds as the antifoggant into the thermally developable material is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and JP-A No. 59-57234.

In the thermally developable material, employed can be sensitizing dyes described, for example, in JP-A Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, November 1978), 1831, Section X (page 437, August 1978). Particularly, selected can advantageously be sensitizing dyes having the spectral sensitivity suitable for spectral characteristics of light sources of various types of scanners. For example, compounds are preferably employed which are described in Japanese Patent Publication Open to Public Inspection Nos. 9-34078, 9-54409, and 9-80679.

Surface active agents, antioxidants, stabilizers, plasticizers, UV absorbers, covering aids, etc. may be employed in the thermally developable material. A binder used in the component layer is the same as that used in the image forming layer, or the binder used in the component layer preferably has a glass transition temperature higher than that used in the image forming layer. Further, the protective layer incorporates a lubricant such as a poly siloxane compound and a wax, and a matting agent. A thickness of the protective layer is preferably between 0.5 and 20.0 $\mu$m, and is more preferably between 1.5 and 10.0 $\mu$m.

Supports employed for the present invention are preferably, in order to minimize the deformation of images after development processing, plastic films (for example, polyethylene terephthalate, polycarbonate, polyimide, nylon, cellulose triacetate, polyethylene naphthalate).

Of these, as preferred supports, listed are polyethylene terephthalate (hereinafter referred to as PET) and other plastics (hereinafter referred to as SPS) comprising styrene series polymers having a syndiotactic structure. A thickness of the support is between about 50 and about 300 $\mu$m, and is preferably between 70 and 180 $\mu$m, and is more preferably between 110 and 140 $\mu$m.

Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point, and are more preferably heated to a temperature at least 35° C. higher than that, and are most preferably heated to a temperature at least 40° C. higher than that.

To adjust electroconductivity, electroconductive compounds, for example, described in U.S. Pat. No. 5,244,773, can be incorporated in the thermally developable material.

In order to adjust the stiffness of the thermally developable material of the present invention within the range defined in the present invention, a polymer latex having low glass transition temperature (Tg) may be contained in said thermally developable material, or a support having low Tg may be employed, or a thickness of a support may be reduced. However, employing said polymer latex is preferred. Tg of said polymer latex is preferably less than 50° C., and more preferably less than 40° C. In order to adjust the breaking stress, the breaking elongation, or the Young's modulus, within the range defined in the present invention, adjusting content of a binder, employment of colloidal silica, and latex, selection of the kind and a thickness of a support are available. In the case of using polymer latex, said polymer latex is basically incorporated in any layer other than a support, however, said polymer latex is preferably incorporated in a layer provided on an image forming layer side, and, said polymer latex is preferably not incorporated in an outermost layer.

Examples of monomers, constituting above mentioned polymer latex of which Tg is low, include acrylic acid ester, methacrylic acid ester, crotonic acid ester, vinyl ester, maleic acid di-ester, fumaric acid di-ester, itaconic acid di-ester, acrylamide derivative, methacrylamide derivative, vinyl ether derivative, and styrene derivative.

Examples of acrylic acid eater include methyl acrylate, ethyl acrylate, n-propyl acrylate, iso-propyl acrylate, n-butyl acrylate, iso-butyl acrylate, tert-butyl acrylate, hexyl acrylate, 2-ethylhexyl acrylate, acetoxyethyl acrylate, phenyl acrylate, 2-methoxy acrylate, 2-ethoxy acrylate, and 2-(2-methoxyethoxy)ethyl acrylate, etc.

Examples of methacrylic acid eater include methyl methacrylate, ethyl methacrylate, n-propyl methacrylate, n-butyl methacrylate, tert-butyl methacrylate, cyclohexyl methacrylate, and 2-hydroxyethyl methacrylate, 2-ethoxyethyl methacrylate, etc.

Examples of crotonic acid ester derivative include butyl crotonate, and hexyl crotonate, etc. Examples of vinyl ester include vinyl acetate, vinyl propionate, vinyl butylate, vinyl methoxy acetate, and vinyl benzoate, etc. Examples of maleic acid di-ester include di-ethyl maleate, di-methyl maleate, and di-butyl maleate, etc. Examples of fumaric acid di-ester include di-ethyl fumarate, di-methyl fumarate, and di-butyl fumarate, etc.

Examples of itaconic acid di-ester include di-ethyl itaconate, di-methyl itaconate, and dibutyl itaconate, etc. Examples of acrylamide include acrylamide, methyl acrylamide, ethyl acrylamide, propyl acrylamide, n-butyl acrylamide, tert-butyl acrylamide, cyclohexyl acrylamide, 2-methoxyethyl acrylamide, dimethyl acrylamide, di-ethyl acrylamide, and phenyl acrylamide, etc. Examples of methacrylamide include methyl methacrylamide, ethyl methacrylamide, n-butyl methacrylamide, tert-butyl methacrylamide, 2-methoxy methacrylamide, di-methyl methacrylamide, and di-ethyl methacrylamide, etc.

Examples of vinyl ether include methyl vinyl ether, butyl vinyl ether, hexyl vinyl ether, methoxyethyl vinyl ether, and di-methylaminoethyl vinyl ether, etc. Examples of styrene derivative include styrene, methylstyrene, dimethylstyrene, trimethylstyrene, ethylstyrene, iso-propylstyrene, butylstyrene, chloromethylstyrene, methoxystyrene, butoxystyrene, acetoxystyrene, chlorostyrene, di-chlorostyrene, bromostyrene, vinyl benzoic acid methyl ether, and 2-methylstyrene, etc.

If Tg of polymers consisting of these monomers is less than 50° C., either homopolymer or copolymer is acceptable in the present invention. Preferred are homopolymer derived from acrylic acid ester, copolymer derived from acrylic acid ester and methacrylic acid ester, copolymer derived from acrylic acid ester and acrylic acid, and copolymer derived from acrylic acid and methacrylic acid.

Polymers derived from vinylidene chloride monomer and polymers derived from monomer represented by the following formula are preferred.

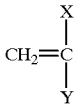

wherein, X represents a hydrogen atom, a halogen atom, a cyano group, or a substituted or an unsubstituted alkyl group, Y represents a hydrogen atom, a halogen atom, a cyano group, a substituted or an unsubstituted alkyl group, or the following groups;

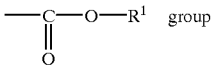

wherein $R^1$ represents a substituted or unsubstituted alkyl or aryl group,

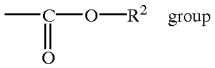

wherein $R^2$ represents a substituted or unsubstituted alkyl or aryl group,

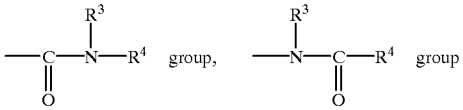

wherein $R^3$ and $R^4$ each represent a substituted or unsubstituted alkyl or aryl group.

Examples of the substituents substituted on the above-cited alkyl group or aryl group include a hydroxy group, a halogen group, a cyano group, an alkyl group, or an aryl group, etc.

Examples of monomers capable of forming coplymers with the above-cited monomers include acrylic acid esters, methacrylic acid esters, acrylic imides, styrenes, vinyl chlorides, vinyl ethers, alkenes, and acrylonitriles.

Exemplified polymer latexes used in the present invention will be now illustrated, but the present invention is not limited thereto.

L-1

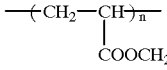

Tg = -21° C.

L-2

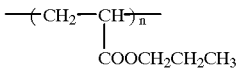

Tg = -36° C.

L-3

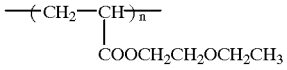

Tg = -47° C.

-continued

L-4

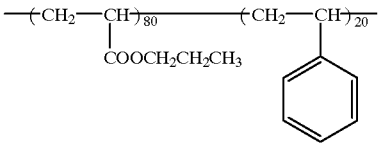

Tg = -20° C.

L-5

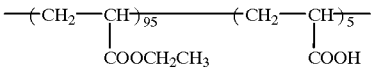

Tg = -11° C.

L-6

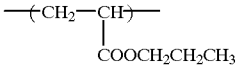

Tg = -53° C.

L-7

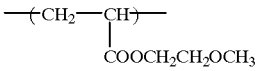

Tg = -45° C.

L-8

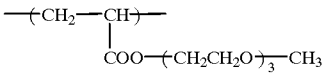

Tg = -36° C.

L-9

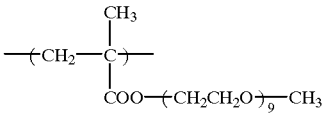

Tg = -18° C.

L-10

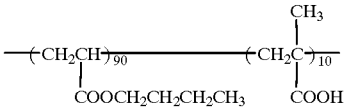

Tg = -26° C.

L-11

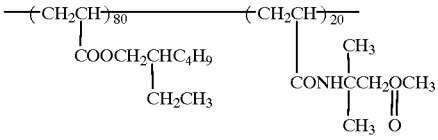

Tg = -17° C.

L-12

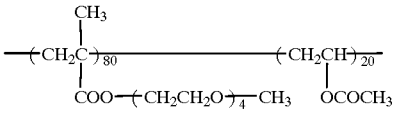

Tg = -4° C.

L-13

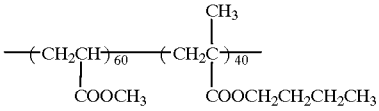

Tg = -15° C.

L-14

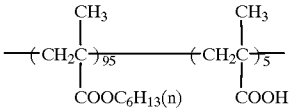

Tg = 6° C.

-continued

L-15

$-(CH_2CH)_{90}-(CH_2CH)_{10}-$
$COOCH_2CH_2CH_2OCH_2CH_3$ COOH

Tg = -2° C.

L-16

$-(CH_2CH)-$
$COOC_2H_5$

Tg = -22° C.

L-17

$-(CH_2CH)-$
$COOCH_3$

Tg = 3° C.

L-18

$-(CH_2CH)-$
$COOC_4H_9$

Tg = -56° C.

L-19

$CH_3$
$-(CH_2C)-$
$COOC_4H_9$

Tg = 21° C.

L-20

$-(CH_2CH)-$
$OCOCH_3$

Tg = 32° C.

L-21

$-(CH_2CH)-$
$C_2H_5$

Tg = -24° C.

L-22

$-(CH_2CH)-$
$COOCH_2C_6H_5$

Tg = 6° C.

L-23

$-(CH_2CH)-$
$isoC_6H_{13}$

Tg = -34° C.

L-24

$-(CH_2CH)-$
$COOC_4H_8CN$

Tg = -40° C.

L-25

$-(CH_2CH)-$
$COOC_2H_4CN$

Tg = 4° C.

L-26

$-(CH_2CH)-$
$COOCH_2CN$

Tg = 23° C.

L-27

$-(CH_2CH)-$
$COOC_2H_4OC_2H_5$

Tg = -50° C.

-continued

L-28

$-(CH_2CH)-$
$COOC_4H_8OCH_3$

Tg = -56° C.

L-29

$-(CH_2CH)-$
$CONHC_4C_9$

Tg = 46° C.

L-30

$CH_3$
$-(CH_2C)-$
$COOC_6H_{13}$

Tg = -5° C.

L-31

$-(CH_2CH)-$
$OCH_3$

Tg = -31° C.

L-32

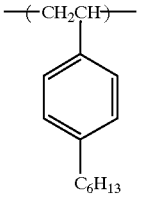

Tg = -27° C.

L-33

$-(CH_2CH)_x-$ $-(CH_2CH)_y-$
$COOCH_3$ CONH
$CH_3-C-CH_3$
$CH_2SO_3Na$ $-(CH_2CH)_z-$
$COOC_2H_4OCO$
$CH_2COCH_3$

Tg = ca. 4° C.

x:y:z = 85:10:5

L-34

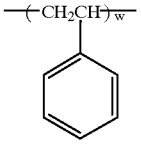

$-(CH_2CH)_w-$ $-(CH_2CH)_x-$ $-(CH_2CH)_y-$
$COOC_4H_9$ COOH $-(CH_2CH)_z-$
$CONHCH_2O$

Tg = ca. 21° C.

w:x:y:z = 52:42:2:4

L-35

$-(CH_2CH)_x-$ $-(CH_2CH)_y-$
$COOCH_3$ $CONHCH_2SO_3Na$

Tg = ca. 5° C.

x:y = 94:6

L-36

$-(CH_2CH)_x-$ $-(CH_2CH)_y-$
$COOCH_3$ $COOC_2H_4OCOCH_2COCH_3$

Tg = ca. 1° C.

x:y = 90:10

-continued

L-37

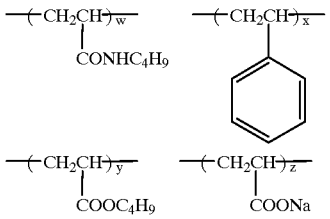

Tg = ca. 15° C.

w:x:y:z = 30:30:30:10

L-38

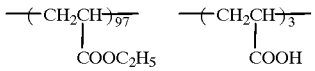

Tg = ca. -21° C.

The above-listed Tg values are calculated values obtained from components of monomers constituting the above-listed homopolymers or copolymers.

These polymer latexes are in the form of fine particles dispersed in an aqueous solution and produced by known methods.

When the content of these polymer latexes having low Tg represents P, P to the total content B of binders contained in all photographic component layers provided on both sides of a support, P preferably satisfies the relationship represented by $0.02 \leqq P/B \leqq 0.6$, and more preferably $0.05 \leqq P/B \leqq 0.4$. When much polymer latex is contained, polymer is adhered onto to rollers in thermal process to result in roller stain, or to give roller marks on the photosensitive material. Further, in order to adjust the stiffness of the thermally developable material within the range defined in the present invention, a support having low Tg can be employed. Specifically, a support having Tg being not lower than 50° C. and not higher than 70° C. is preferably employed, for example, polyethyleneterephthalate (PET) having a butylene group such as butylene glycol or the like. In the case of employing said PET, a thickness of the support is preferably from 100 to 150 μm, and is more preferably from 110 to 130 μm.

For the use in the printing and plate-making field, a hydrazine compound is preferably incorporated in the thermally developable photosensitive material. Preferable hydrazine compounds represented by the following formulas (1), (2), or (3) are shown below.

Formula (1)

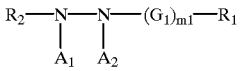

wherein $R_1$ represents a hydrogen atom or a blocking group; $R_2$ represents an aliphatic group or heterocyclic group; $G_1$ represents a —CO— group, a —COCO— group, a —CS-group, a —$SO_2$— group, a —SO— group, a —PO ($R_3$)— group ($R_3$ is identical to $R_1$, and $R_3$ may be the same as $R_1$ or different from $R_1$), or an iminomethylene group. $A_1$ and $A_3$ each represent a hydrogen atom, or one of them represents a hydrogen, while the other one represents an alkylsulfonyl group, an arylsulfonyl group, or a substituted or unsubstituted acyl group. $m_1$ is an integer of 0 or 1; when $m_1$ is 0, $R_1$ represents an aliphatic group, an aromatic group, or heterocyclic group.

$R_{23}CONHNH_2$ Formula (2)

wherein $R_{23}$ represents a substituted or unsubstituted hydrazino group, an alkylamino group, a sulfonylamino group, a ureide group, an oxycarbonylamino group, an alkynyl group, or an unsubstituted amino group.

Formula (3)

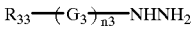

wherein $R_{33}$ represents an aliphatic group, an aromatic group, a heterocyclic group, a group having a nitrogen atom attached to $G_3$ or a group having an oxygen atom attached to $G_3$; $G_3$ represents a —COCO— group, a —CS— group, a —$SO_2$— group, a —SO— group, a —PO ($R_{35}$)— group ($R_{35}$ is identical to $R_{33}$, and $R_{35}$ may be the same as $R_{33}$ or different from $R_{33}$), or an iminomethylene group. $n_3$ is an integer of 0 or 1; when $n_3$ is 0, $R_{33}$ represents a heterocyclic group.

In the general formula (1), examples of aliphatic group represented by $R_2$ include a substituted or unsubstituted straight, branched or cyclic alkyl group, alkenyl group or alkynyl group, having 1 to 30 carbon atoms . Examples of aromatic groups represented by $R_2$ include aryl groups consisting of a mono cyclic ring or a condensed cyclic ring, and for example, examples of said groups include a benzene ring or a naphthalene ring. Examples of heterocyclic groups represented by $R_2$ include heterocyclic groups consisting of a mono cyclic ring or a condensed cyclic ring being a saturated or unsaturated aromatic group or nonaromatic group, for example, examples of said heterocyclic groups include a pyridine ring, a primidine ring, an imidazole ring, a pyrrazole ring, a quinoline ring, an iso-quinoline ring, a benzimidazole ring, a thiazole ring, a benzothiazole ring, a piperidine ring, a triazine ring, a morpholine ring, or a piperazine ring. etc.

As preferable $R_2$, are cited aryl groups or alkyl groups.

$R_2$ may be substituted, and examples of representative substitiuents include a halogen atom, an alkyl group (an alkyl group, a cycloalkyl group, an active methylene group, etc.), an alkenyl group, an alkynyl group, an aryl group, a heterocyclic group, a heterocyclic group having a quaternary nitrogen atom (for example, a pyridinio group), an acyl group, an alkoxycarbonyl group, an aryloxycarbonyl group, a carbamoyl group, a carboxy group or its salt, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group having repetition unit consisting of an ethyleneoxy group or a propyleneoxy group), an aryloxy group, a heterocyclicoxy group, an acyloxy group, (an alkoxy or aryloxy)carbonyloxy group, a carbamoyloxy group, a sulfonyloxy group, an amino group, (an alkyl, an aryl, or a heterocyclic)amino group, a nitrogen containing heterocyclic group on whose nitrogen atom is substituted, an acylamino group, a sulfonamide group, a ureide group, a thioureide group, an imide group. (an alkoxy or an aryloxy)carbonylamino group, a sulfamoylamino group, a semicarbazido group, a thiosemicarbazido group, a hydrazino group, a quaternary ammonio group, an oxamoylamino group, (an alkyl or aryl) sulfonylureide group, an acylureide group, an acylsulfamoylamino group, a nitro group, a mercapto group, (an alkyl, aryl or heterocyclic)thio group, (an alkyl or aryl)sulfonyl group, (an alkyl or aryl)sulfinyl group, a sulfo group or its salt, a sulfamoyl group. an acylsulfamoyl group, a sulfonylsulfamoyl group or its salt, a group having a phosphoric acid amide group or a phosphoric acid ester group. These substituents may be substituted with similar substituents mentioned-above.

Preferred examples of substituents, which $R_2$ may contain in its moiety, in the case of $R_2$ representing an aromatic group or heterocyclic group, include an alkyl group (including active methylene group), an aralkyl group, a heterocyclic group, a substituted amino group, an acylamino group, a sulfonamide group, a ureide group, a sulfamoylamino group, an imide group, a thioureide group, a phophoric acid amide group, a hydroxy group, an alkoxy group, an aryloxy group, an acyloxy group, an acyl group, an alkoxycarbonyl group, an aryloxycarbonyl group, a carbamoyl group, a carboxy group (including its salt), (an alkyl, an aryl or a heterocyclic)thio group, a sulfo group (including its salt), a sulfamoyl group, a halogen atom, a cyano group, and a nitro group. Furthermore, when $R_2$ represents an aliphatic group, preferred examples of substituents, which $R_2$ may contain in its moiety, include an alkyl group, an aryl group, a heterocyclic group, an amino group, an acylamino group, a sulfonamide group, a ureido group, a sulfamoylamino group, an imide group, a thioureide group, a phosphoric acid amide group, a hydroxy group, an alkoxy group, an aryloxy group, an acyloxy group, an acyl group, an alkoxycarbonyl group, an aryloxycarbonyl group, a carbamoyl group, a carboxy group (including its salt), (an alkyl, an aryl or a heterocyclic)thio group, a sulfo group (including its salt), a sulfamoyl group, a halogen atom, a cyano group, or a nitro group.

In the general formula (1), examples of blocking groups represented by $R_1$ include an aliphatic group (e.g. an alkyl group, an ankenyl group, and alkynyl group), an aromatic group (a mono ring or a condensed ring aryl group), a heterocyclic group, an alkoxy group, an aryloxy group, an amino group or hydrazino group. Examples of alkyl groups include a substituted or unsubstituted alkyl group having 1 to 10 carbon atoms, and are cited a methyl group, an ethyl group, a trifluoromethyl group, a difluoromethyl group, a 2-carboxytetrafluoroethyl group, a pyridiniomethyl group, a difluoromethoxymethyl group, a difluorocarboxymethyl group, a 3-hydroxypropyl group, a 3-methanesulfonamidepropyl group, a phenylsulfomethyl group, a 4-ethylphenoxymethyl group, a phenylthiomethyl group, an o-hydroxybenzyl group, a methoxymethyl group, a phenoxymethyl group, a 4-ethylphenoxymethyl group, a phenylthiomethyl group, a t-butyl group, a dicyanomethyl group, a diphenylmethyl group, a triphenylmethyl group, a methoxycarbonyldiphenylmethyl group, a cyanodiphenylmethyl group, a methythiodiphenylmethyl group, etc. Preferred alkenyl group is one having 1 to 10 carbon atoms, and examples of alkenyl groups include a vinyl group, a 2-ethoxycarbonylvinyl group, a 2-trifluoro-2-methoxycarbonylvinyl group, etc. Preferred alkynyl group is one having 1 to 10 carbon atoms, and examples of alkynyl groups include an ethynyl group, a 2-methoxycarbonylethynyl group, etc. Preferred aryl group contains a mono ring or a condensed ring, and more preferred aryl group is a group consisting of a benzene ring. Examples of said aryl groups include a phenyl group, a perfluorophenyl group, a 3,5-dichlorophenyl group, a 2-methanesulfonamidephenyl group, a 2-carbamoylphenyl group, a 4,5-dicyanophenyl group. a 2 -hydroxymethylphenyl group, a 2,6-dichloro-4-cyanophenyl group, or a 2-chloro-5-octylsulfamoylphenyl group.

Preferred heterocyclic groups are saturated or unsaturated heterocyclic groups (being a 5 or 6 membered mono ring or condensed ring), containing at least a nitrogen, oxygen or sulfur atom. Examples of heterocyclic groups include a morpholino group, a piperidino group (N-substituted), an imidazolyl group, an indazolyl group (a 4-nitroindazolyl group), a pyrazolyl group, a triazolyl group, a benzimidazolyl group, a tetrazolyl group, a pyridyl group, a prydinio group ( a n N-methyl-3-pyridinio group), a quinolinio group, or a quinolyl group. Preferred alkoxy group is one having 1 to 8 carbon atoms, and examples of said alkoxy groups include a methoxy group, 2-hydroxyethoxy group, a benzyloxy group, and a t-butoxy group. Preferred aryloxy group is a substituted or unsubstituted phenoxy group, and examples of preferred amino group are an unsubstituted amino group, an alkylamino group, arylamino group having 1 to 10 carbon atoms, or a saturated or unsaturated heterocyclic amino group (including a nitrogen containing heterocyclic amino group having a quaternary nitrogen atom). Examples of amino groups include a 2,2,6.6-tetramethylpiperidine-4-ylamino group, a propylamino group, a 2-hydroxyethylamino group, an anilino group, an o-hydroxyanilino group, a 5-benzotriazolylamino group, and an N-benzyl-3-pyridinioamino group. Preferred hydrazino group is a substituted or an unsubstituted hydrazino group (a 4-benzenesulfonamidephenyl hydrazino group, etc.).

A group represented by $R_1$ may be substituted, and substituents for $R_1$ are the same as those for $R_2$.

In the general formula (1), —$G_1$—$R_1$ may form a ring structure, and said ring structure is described in JP-A No. 63-29751.

Hydrazine compounds represented by the general formula (1) may have an adsorption group which enables said hydrazine compounds to adsorb to silver halide. Examples of said adsorption groups include an alkylthio group, a arylthio group, a thiourea group, a thioamide group, a mercapto heterocyclic group or a triazole group. The above-mentioned adsorption groups are described in U.S. Pat. Nos. 4,385,108, 4,459,347, JP-A Nos. 59-195233, 59-200231, 59-201045, 59-201046, 59-201047, 59-201048, 59-201049, 61-170733, 61-270744, 62-948, 63-234244, 63-234245, and 63-234246. Furthermore, these adsorption groups to silver halide include a precursor type group, and examples of said precursor type groups are described in JP-A No. 2-285344.

In the formula (1), $R_1$ or $R_2$ may contain, in its moiety, a ballast group which is employed in immobilized photographically useful additives such as couplers, or $R_1$ or $R_2$ may be a moiety capable of being polymerized. Said ballast group has at least 8 carbons and is relatively photographically inactive. Examples of said ballast groups include an alkyl group, an aralkyl group, an alkoxy group, a phenyl group, an alkylphenyl group, a phenoxy group, or an alkylphenoy group, etc. Further, examples of polymerized groups are described in JP-A 1-100530.

In the general formula (1), $R_1$ or $R_2$ may contain plural hydrazino groups, and in this case, compounds represented by the general formula (1) are poly functional based on hydrazino groups. Examples of compounds having poly functional hydrazino groups are described in JP-A Nos. 64-86134, 4-16938, 5-197091, WO Nos. 95-32452, and 95-32453.

$R_1$ or $R_2$ of the general formula (1) may contain a cationic group (a group having a quaternary ammonio group, or a nitrogen containing heterocyclic group having a quaternary nitrogen atom), a group having repeating unit of an ethyleneoxy group or a propyreneoxy group, (an alkyl, an aryl, or a heterocyclic)thio group, or a dissociation group capable of being dissociated with base (a carboxy group, a sulfo group, an acylsulfamoyl group, and a carbamoylsulfamoyl group, etc.). Examples of compounds, in which the above-mentioned groups are contained, are described in JP-A Nos. 3-259240, 5-45761, 5-333466, 6-19031, 6-19032, 7-5610, 7-234471, 7-244348, U.S. Pat. Nos. 4,988.604. 4,994,365, and German Patent No. 4,006,032.

Preferred examples of $A_1$ and $A_2$ of the general formula (1) include a hydrogen atom, an alkyl or arylsulfonyl group having not more than 20 carbon atoms (being preferred a phenylsufonyl group, or a substituted phenylsulfonyl group in which the sum total of Hammett's substituent constants of all substituents is not less than −0.5), an acyl group having not more than 20 carbon atoms [being preferred a benzoyl group, or a substituted benzoyl group in which the sum total of Hammett's substituent constants of all substituents is not less than −0.5; or straight, branched, or cyclic substituted or unsubstituted aliphatic acyl group (herein, examples of substituents including a halogen atom, an ether group, a sulfonamide group, a carbonamide group, a hydroxy group, a carboxy group, a sulfo group, etc.]. Of these, a hydrogen atom is most preferable.

Exemplified hydrazine compounds represented by the formula (1) are listed below, but the present invention is not limited thereto.

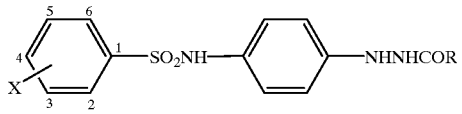

| | X = | R = —H | R = —(CF$_2$)$_2$COOH or —(CF$_2$)$_2$COOK | R = 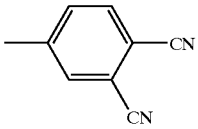 | R = 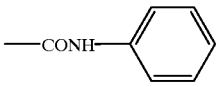 |
|---|---|---|---|---|---|
| 1 | 3-NHCOC$_9$H$_{19}$ | 1-1 | 1-2 | 1-3 | 1-4 |
| 2 | 3-NHCONHCH$_2$CH$_2$SC$_7$H$_{15}$ | 2-1 | 2-2 | 2-3 | 2-4 |
| 3 | 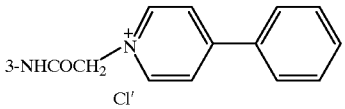 | 3-1 | 3-2 | 3-3 | 3-4 |
| 4 | 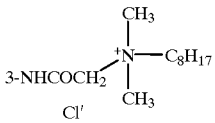 | 4-1 | 4-2 | 4-3 | 4-4 |
| 5 | 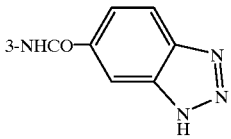 | 5-1 | 5-2 | 5-3 | 5-4 |
| 6 | 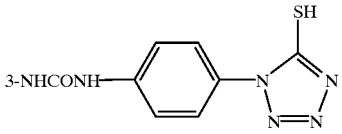 | 6-1 | 6-2 | 6-3 | 6-4 |
| 7 | 2,4-(CH$_3$)$_2$, 3-SCH$_2$CH$_2$(OCH$_2$CH$_2$)$_4$OC$_8$H$_{17}$ | 7-1 | 7-2 | 7-3 | 7-4 |

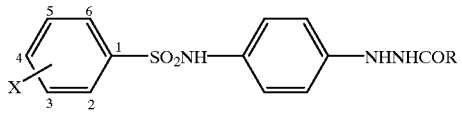

-continued
| | X = | R = —H | —$CF_2H$ | —$CH_2O$— 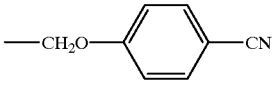 —CN | —CONH— 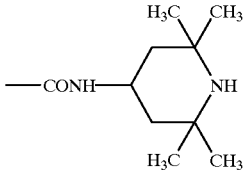 |
|---|---|---|---|---|---|
| 8 | 3-$CONHCH_2CH(C_2H_5)C_4H_9$ | 8-1 | 8-2 | 8-3 | 8-4 |
| 9 | 6-$OC_4H_9$, 3-$C_5H_{11}$(t) | 19-1 | 9-2 | 9-3 | 9-4 |
| 10 | 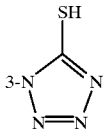 | 10-1 | 10-2 | 10-3 | 10-4 |
| 11 | 3-$NHCOCH_2SCH$ 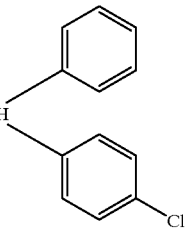 | 11-1 | 11-2 | 11-3 | 11-4 |
| 12 | 4-$NHCOCH_2S$ 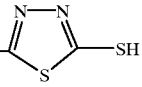 —SH | 12-1 | 12-2 | 12-3 | 12-4 |
| 13 | 3-$NHCOCH(CH_2COOH)C_8H_{17}$ | 13-1 | 13-2 | 13-3 | 13-4 |
| 14 | 3,5-$(CONHCH_2CH(C_2H_5)C_4H_9)_2$ | 14-1 | 14-2 | 14-3 | 14-4 |
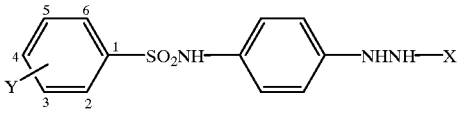
| | Y = | X = —CHO | —$COCF_3$ | —$SO_2CH_3$ | —P(O)$(OC_2H_5)_2$ |
|---|---|---|---|---|---|
| 15 | 3-$NHCOCH_2$— 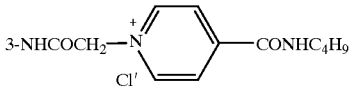 | 15-1 | 15-2 | 15-3 | 15-4 |

-continued
| | | | | | |
|---|---|---|---|---|---|
| 16 | 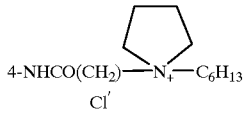 | 16-1 | 16-2 | 16-3 | 16-4 |
| 17 | $3\text{-}SO_2NHCH_2(OHC_2CH_2)_4OC_4H_9$ | 17-1 | 17-2 | 17-3 | 17-4 |
| 18 | $3,4\text{-}(COOCH(CH_3)COOC_4H_9)_2$ | 18-1 | 18-2 | 18-3 | 18-4 |
| 19 | 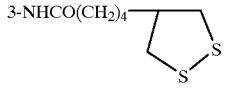 | 19-1 | 19-2 | 19-3 | 19-4 |
| 20 | $3\text{-}NHSO_2NHC_8H_{17}$ | 20-1 | 20-2 | 20-3 | 20-4 |
| 21 | 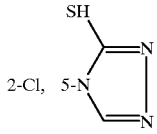 | 21-1 | 21-2 | 21-3 | 21-4 |
| | | R = | | | |
|---|---|---|---|---|---|
| | | —H | —$CF_3$ | 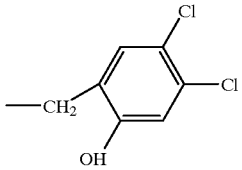 | —CONH—$CH_2CH_2OH$ |
| 22 | 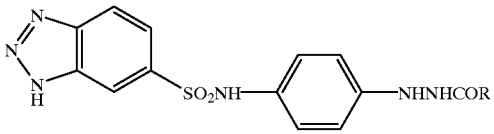 | 22-1 | 22-2 | 22-3 | 22-4 |
| 23 | 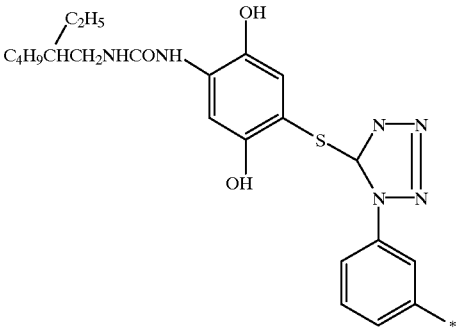 | 23-1 | 23-2 | 23-3 | 23-4 |
*-$SO_2NH$—$C_6H_4$—NHNHCOR -continued
| | | | | |
|---|---|---|---|---|
| 24 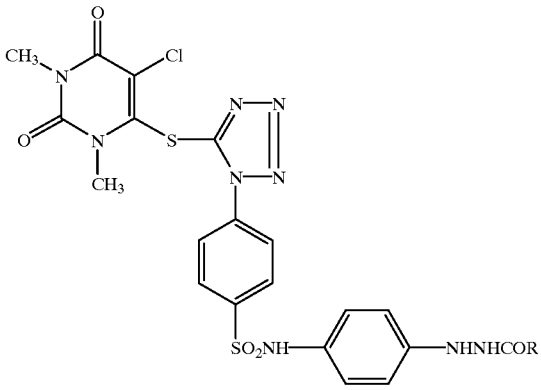 | 24-1 | 24-2 | 24-3 | 24-4 |
| 25 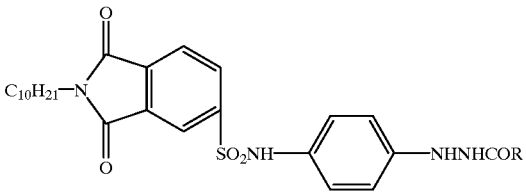 | 25-1 | 25-2 | 25-3 | 25-4 |
| 26 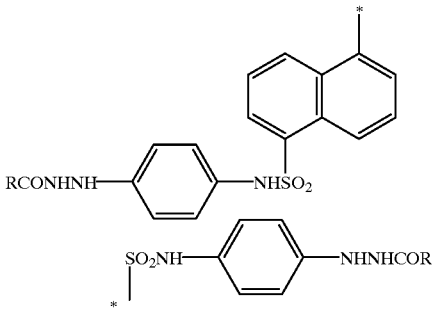 | 26-1 | 26-2 | 26-3 | 26-4 |
| 27 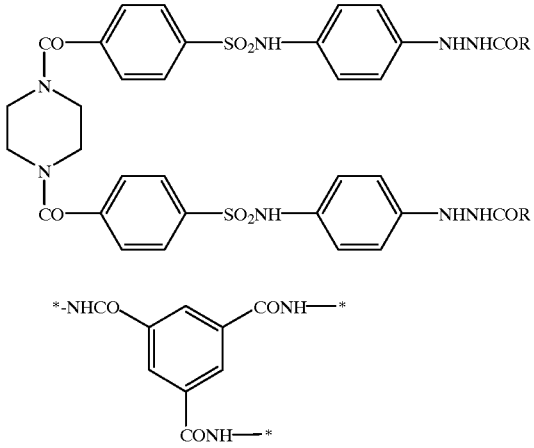 | 27-1 | 27-2 | 27-3 | 27-4 |
| 28 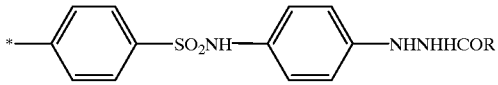 | 28-1 | 28-2 | 28-3 | 28-4 |

-continued
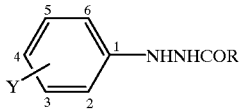
| | | R = | | | |
|---|---|---|---|---|---|
| | | 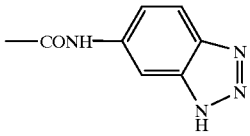 | —$CH_2OCH_3$ | 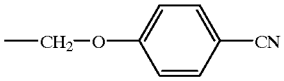 | |
| | Y = | —H | | | |
| 29 | 4-NHCSNH—$C_8H_{17}$(n) | 29-1 | 29-2 | 29-3 | 29-4 |
| 30 | 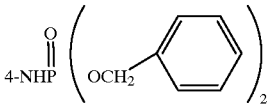 | 30-1 | 30-2 | 30-3 | 30-4 |
| 31 | 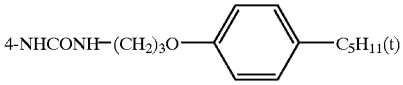 | 31-1 | 31-2 | 31-3 | 31-4 |
| 32 | 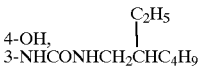 | 32-1 | 32-2 | 32-3 | 32-4 |
| 33 | 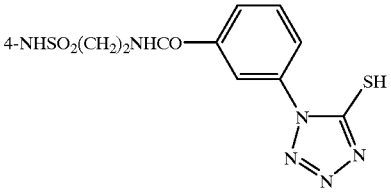 | 33-1 | 33-2 | 33-3 | 33-4 |
| 34 | 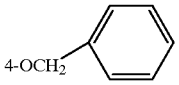 | 34-1 | 34-2 | 34-3 | 34-4 |
| 35 | 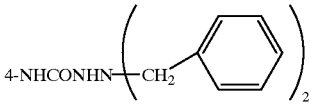 | 35-1 | 35-2 | 35-3 | 35-4 |
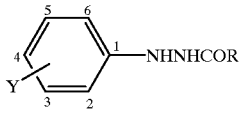
| | R = | | |
|---|---|---|---|
| | 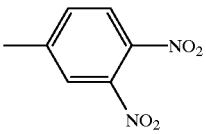 | | |
| Y = | —H | —$CF_2SCH_2$ | —$CONHCH_3$ |

-continued
| | | | | | |
|---|---|---|---|---|---|
| 36 | 2-$NHSO_2CH_3$, 4-$NHCONH(CH_2)_3$ 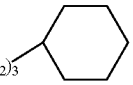 | 36-1 | 36-2 | 36-3 | 36-4 |
| 37 | 2-$OCH_3$, 4-$NHSO_2C_{12}H_{25}$ | 37-1 | 37-2 | 37-3 | 37-4 |
| 38 | 3-$NHCOC_{11}H_{23}$, 4-$NHSO_2CF_3$ | 38-1 | 38-2 | 38-3 | 38-4 |
| 39 | 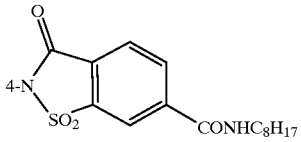 | 39-1 | 39-2 | 39-3 | 39-4 |
| 40 | 4-$OOC(CH_2)_2COOC_6H_{13}$ | 40-1 | 40-2 | 40-3 | 40-4 |
| 41 | 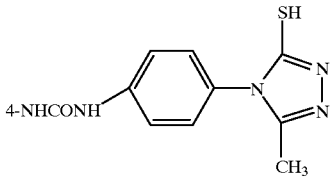 | 41-1 | 41-2 | 41-3 | 41-4 |
| 42 | 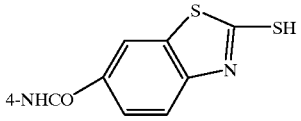 | 42-1 | 42-2 | 42-3 | 42-4 |
43
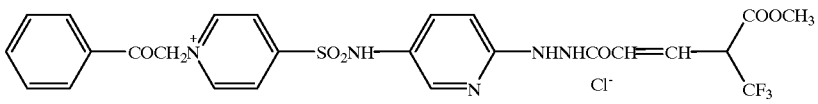
44
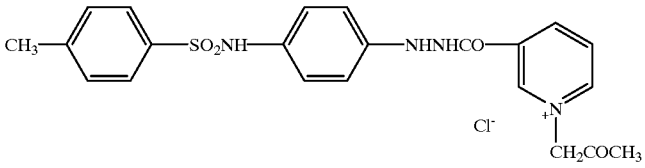
45
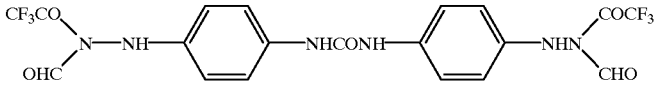
46
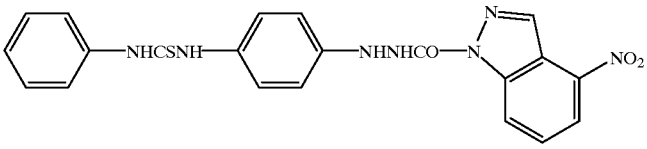
47
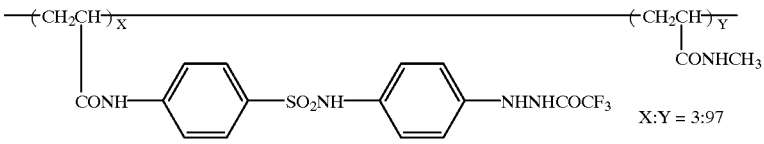
X:Y = 3:97
Weight average molecular weight ≈ 100,000

-continued
48
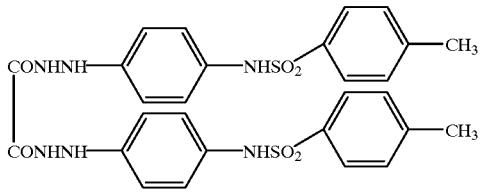
49
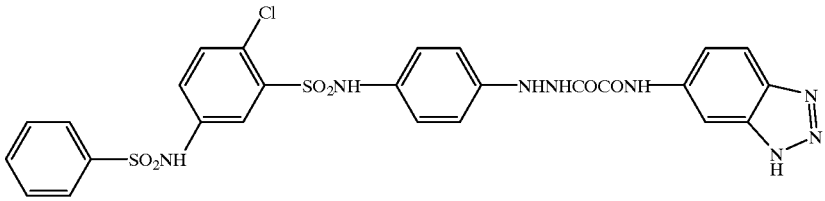
50
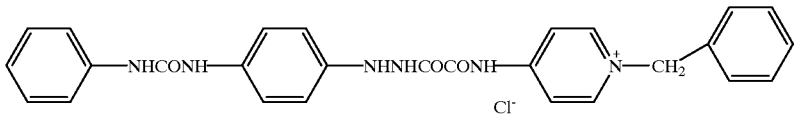
51
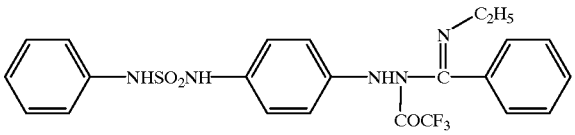
52
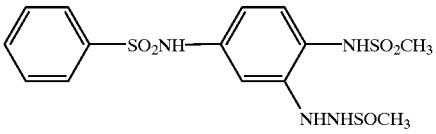
53
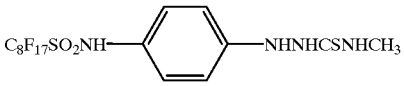
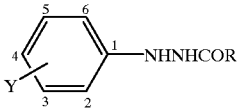
| | | R = | | | |
|---|---|---|---|---|---|
| | Y = | —H | —$CH_2OCH_3$ | —$CH_2O$— 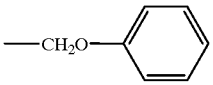 | —$CONHC_3H_7$ |
| 54 | 2-$OCH_3$ | 54-1 | 54-2 | 54-3 | 54-4 |
| 55 | 2-$OCH_3$, 5-$C_8H_{17}$(t) | 55-1 | 55-2 | 55-3 | 55-4 |
| 56 | 4-$NO_2$ | 56-1 | 56-2 | 56-3 | 56-4 |
| 57 | 4-$CH_3$ | 57-1 | 57-2 | 57-3 | 57-4 |
| 58 | 4-NHCO— 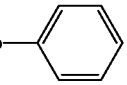 | 58-1 | 58-2 | 58-3 | 58-4 |

-continued
| | | | | | |
|---|---|---|---|---|---|
| 59 | 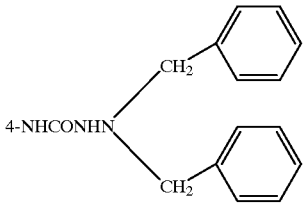 | 59-1 | 59-2 | 59-3 | 59-4 |
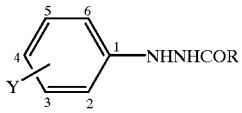
| | | R = | | | |
|---|---|---|---|---|---|
| | Y = | —H | 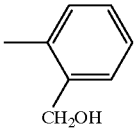 | 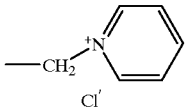 | 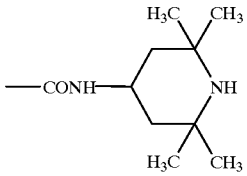 |
| 60 | 2-$OCH_3$, 5-$OCH_3$ | 60-1 | 60-2 | 60-3 | 60-4 |
| 61 | 4-$C_8H_{17}$(t) | 61-1 | 61-2 | 61-3 | 61-4 |
| 62 | 2-$OC_2H_5$ | 62-1 | 62-2 | 62-3 | 62-4 |
| 63 | 3-$NO_2$ | 63-1 | 63-2 | 63-3 | 63-4 |
| 64 | 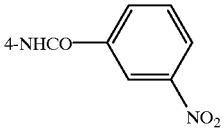 | 64-1 | 64-2 | 64-3 | 64-4 |
| 65 | 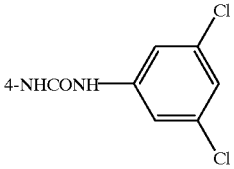 | 65-1 | 65-2 | 65-3 | 65-4 |
$R_1$—NHNHCO$R_2$
| | $R_2$ = | | | |
|---|---|---|---|---|
| $R_1$ = | —H | 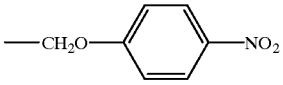 | 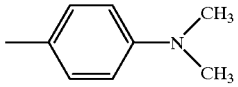 | 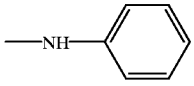 |
| 66 | 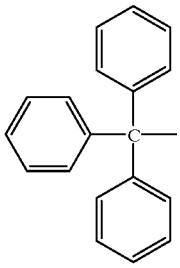 | 66-1 | 66-2 | 66-3 | 66-4 |

-continued
| | | | | |
|---|---|---|---|---|
| 67 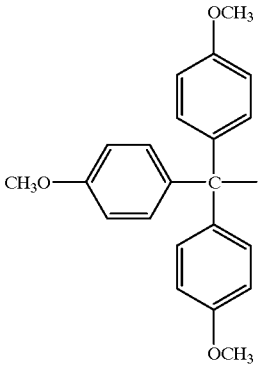 | 67-1 | 67-2 | 67-3 | 67-4 |
| 68 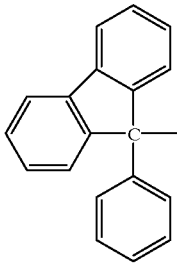 | 68-1 | 68-2 | 68-3 | 68-4 |
| 69 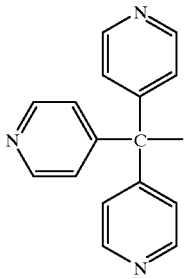 | 69-1 | 69-2 | 69-3 | 69-4 |
| 70 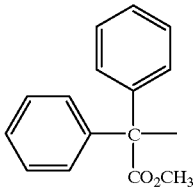 | 70-1 | 70-2 | 70-3 | 70-4 |
| 71 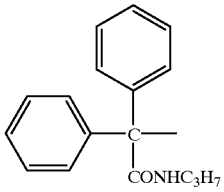 | 71-1 | 71-2 | 71-3 | 71-4 |
| | $R_1$—NHNHCOR$_2$ | | | |
|---|---|---|---|---|
| | | | $R_2$ = | |
| $R_1$ = | —CONHC$_3$H$_7$ | —COOC$_4$H$_9$(t) | —OC$_4$H$_9$(t) | 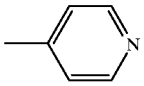 |

-continued
| | | | | | |
|---|---|---|---|---|---|
| 72 | 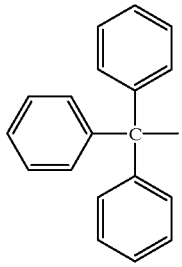 | 72-1 | 72-2 | 72-3 | 72-4 |
| 73 | 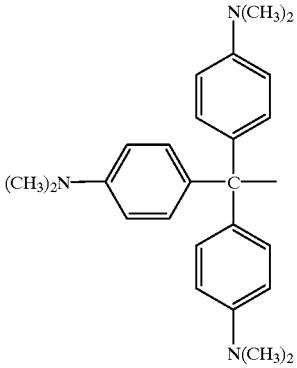 | 73-1 | 73-2 | 73-3 | 73-4 |
| 74 | 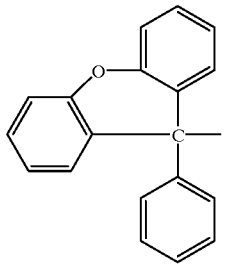 | 74-1 | 74-2 | 74-3 | 74-4 |
| 75 | 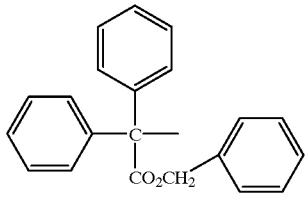 | 75-1 | 75-2 | 75-3 | 75-4 |
| 76 | 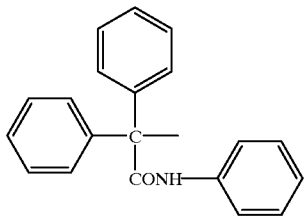 | 76-1 | 76-2 | 76-3 | 76-4 |

-continued
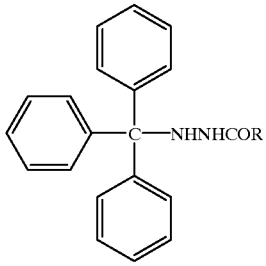
R =
77
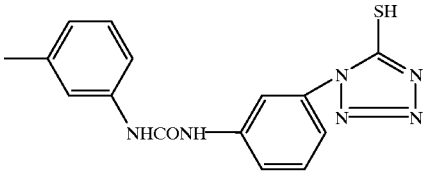
78
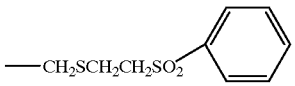
79 —$CH_2OCH_2CH_2SCH_2CH_2OCH_3$
80 —$CF_2CF_2COOH$
81
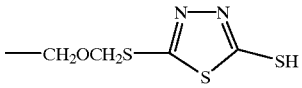
82
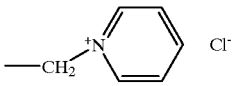
83
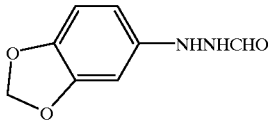
84
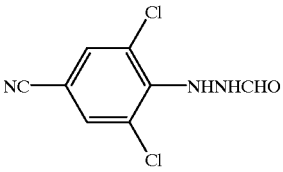
85
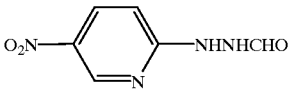
86
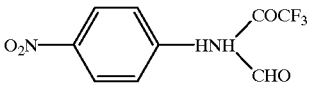
87
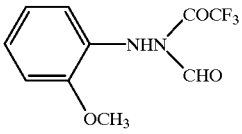

-continued
88
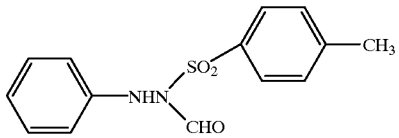
89
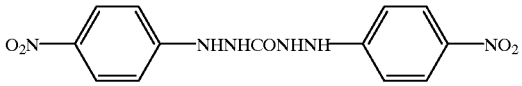
90
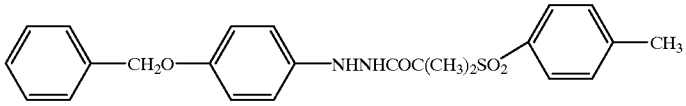
91
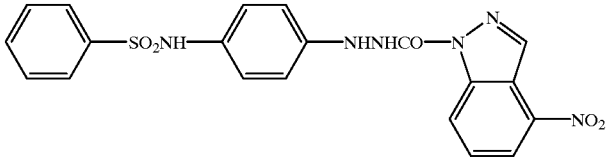
92
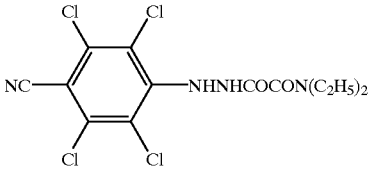
93
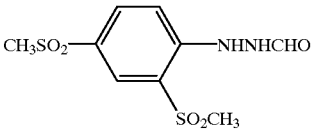
94
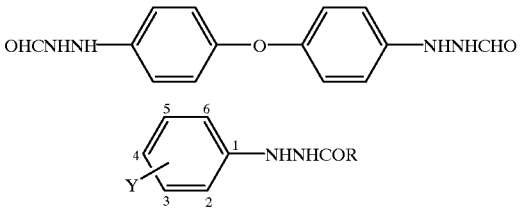
| | | R = | |
|---|---|---|---|
| | Y = | 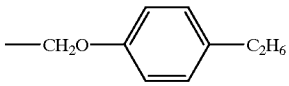 | 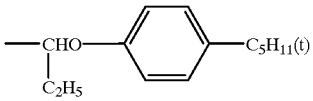 |
| 95 | 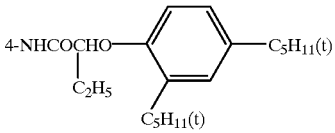 | 95-1 | 95-2 |
| 96 | 4-COOH | 96-1 | 96-2 |
| 97 | 4-NHCSNHC$_2$H$_5$ | 97-1 | 97-2 |

-continued
| | | | |
|---|---|---|---|
| 98 | 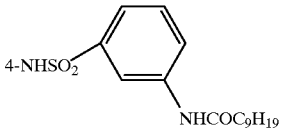 | 98-1 | 98-2 |
| 99 | 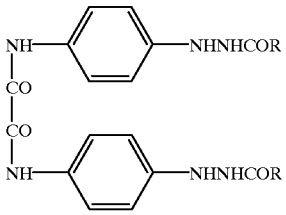 | 99-1 | 99-2 |
| 100 | 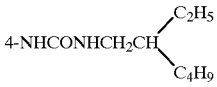 | 100-1 | 100-2 |
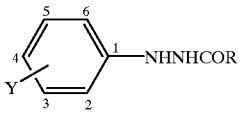
| R = | |
|---|---|
| 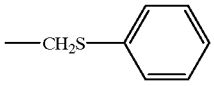 | —$CH_2Cl$ |
| | | | |
|---|---|---|---|
| 95 | 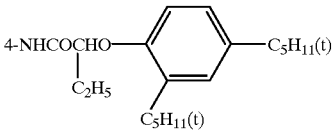 | 95-3 | 95-4 |
| 96 | 4-COOH | 96-3 | 96-4 |
| 97 | 4-NHCSNHC$_2$H$_5$ | 97-3 | 97-4 |
| 98 | 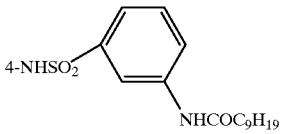 | 98-3 | 98-4 |
| 99 | 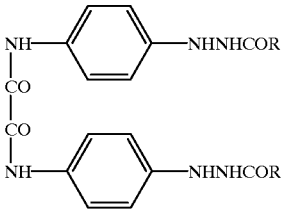 | 99-3 | 99-4 |
| 100 | 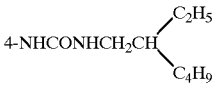 | 100-3 | 100-4 |

-continued
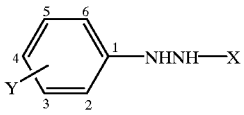
X =
| | Y = | $COCH_2SO_2$ | $SO_2$ $CH_3$ |
|---|---|---|---|
| 101 | 4-$NO_2$ | 101-1 | 101-2 |
| 102 | 2,4-$(OCH_3)_2$ | 102-1 | 102-2 |
| 103 | 4-$NHCOCH_2O$ $C_5H_{11}(t)$ | 103-1 | 103-2 |
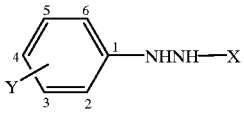
X =
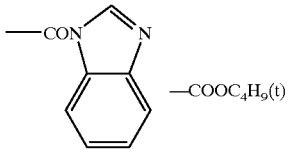
| | | | |
|---|---|---|---|
| 101 | 4-$NO_2$ | 101-3 | 101-4 |
| 102 | 2,4-$(OCH_3)_2$ | 102-3 | 102-4 |
| 103 | 4-$NHCOCH_2O$ $C_5H_{11}(t)$ | 103-3 | 103-4 |
X =
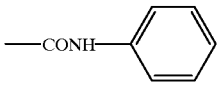
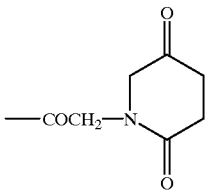
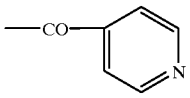
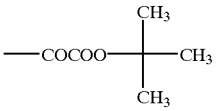
| | Y = | | | | |
|---|---|---|---|---|---|
| 104 | 4-$NHCONHCH_2CH_2SC_4H_9$ | 104-1 | 104-2 | 104-3 | 104-4 |
| 105 | 4-$NHSO_2$ $NO_2$ | 105-1 | 105-2 | 105-3 | 105-4 |

-continued
| | | Y—NHNH—X | | | |
|---|---|---|---|---|---|
| | | X = | | | |
| | Y = | 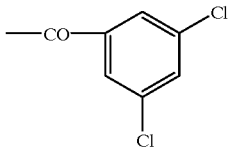 | —CHO | —$COCH_2OCH_3$ | —$COOC_4H_9$(t) |
| 106 | (t)$C_4H_9$— | 106-1 | 106-2 | 106-3 | 106-4 |
| 107 | 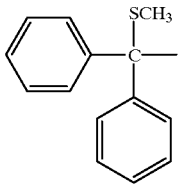 | 107-1 | 107-2 | 107-3 | 107-4 |
| 108 | 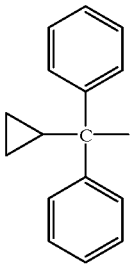 | 108-1 | 108-2 | 108-3 | 108-4 |
| 109 | 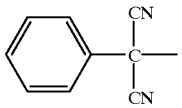 | 109-1 | 109-2 | 109-3 | 109-4 |
| 110 | 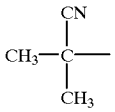 | 110-1 | 110-2 | 110-3 | 110-4 |
| 111 | 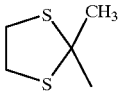 | 111-1 | 111-2 | 111-3 | 111-4 |
| | Y—NHNH—X | | | |
|---|---|---|---|---|
| | X = | | | |
| Y = | 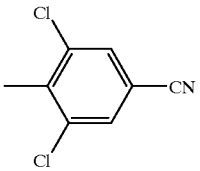 | 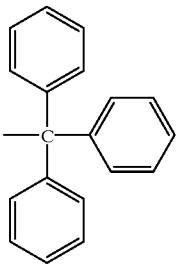 | 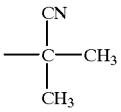 | 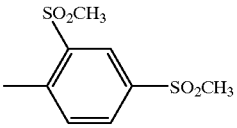 |

-continued
| | | | | | |
|---|---|---|---|---|---|
| 112 | 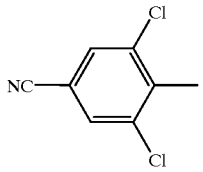 | 112-1 | 112-2 | 112-3 | 112-4 |
| 113 | 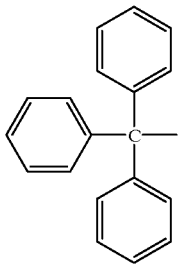 | 113-1 | 113-2 | 113-3 | 113-4 |
| 114 | 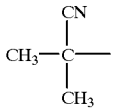 | 114-1 | 114-2 | 114-3 | 114-4 |
| 115 | 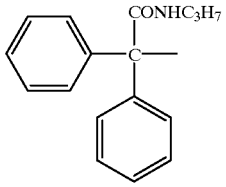 | 115-1 | 115-2 | 115-3 | 115-4 |
| 116 | 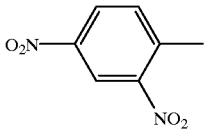 | 116-1 | 116-2 | 116-3 | 116-4 |
| 117 | 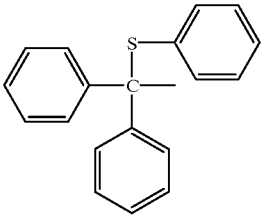 | 117-1 | 117-2 | 117-3 | 117-4 |
118
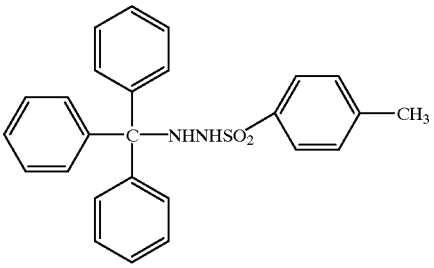

-continued
119
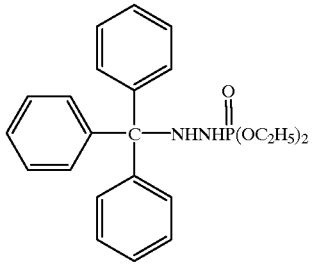
120
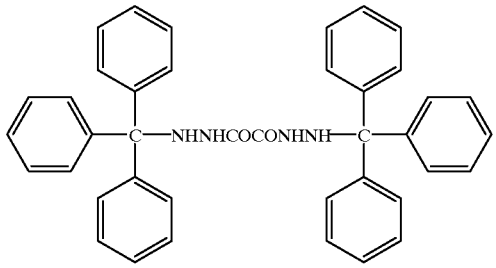
121
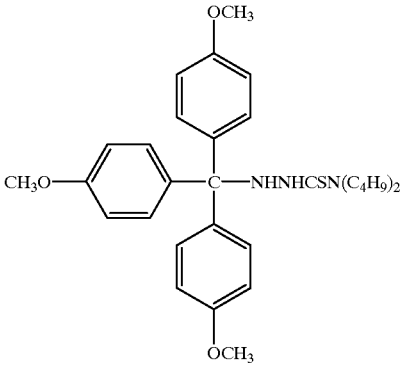
122
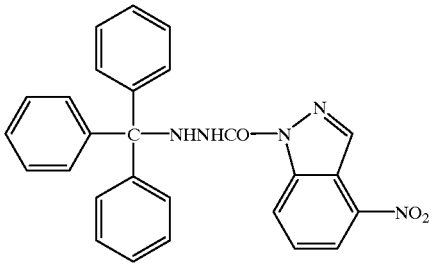
123
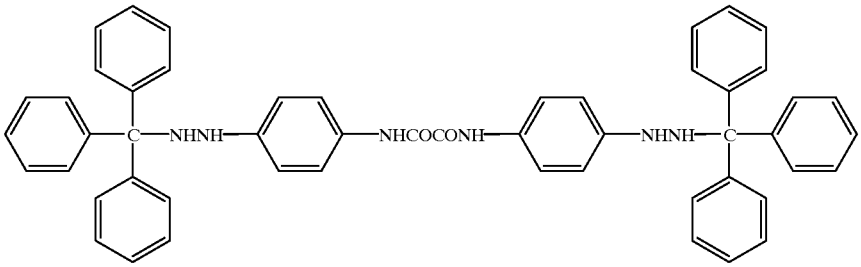
These compounds are synthesized by methods described in Japanese Patent Examined Publication Nos. 6-77138, 6-93082, JP-A Nos. 6-23049, 6-289520, 6-313936, 6-313951, 7-5610, 7-7783 and 104426, etc.

In the general formula (2), an alkyl group of an alkylamino group represented by $R_{23}$ is a straight, branched or cyclic alkyl group having 1 to 16 carbon atoms, and examples of said alkyl group include a methyl group, an ethyl group, a propyl group, an iso-propyl group, a n-butyl group, a t-butyl group, a 2,4,4-trimethylpentyl group, a 2-butenyl group, a 2-hydroxyethyl group, a benzyl group, a 4-methylbenzyl group, a 2-methoxyethyl group, a cyclopentyl group, a 2-acetamideethyl group. As an alkynyl group represented by $R_{23}$, preferred is one having 2 to 18 carbon atoms, more preferred is one having 2 to 10 carbon atoms, and for example, are cited an ethynyl group and a phenylethynyl group.

Substituents, which $R_{23}$ may contain, are an alkyl group, an alkenyl group, an alkynyl group, a hydroxy group, a mercapto group, a nitro group, a carboxy group, a cyano group, a halogen atom, an aryl group, a heterocyclic group (including a heterocyclic group containing a quaternary nitrogen atom), a mercapto-substituted-heterocyclic group, an alkoxy group (including repeating units consisting of an ethyleneoxy group or propyleneoxy group), an aryloxy group, an acylamino group, an alkylamino group, an anilino group, a quaternary ammonium group, a ureide group, a sulfamoyl group, an alkylthio group, an arylthio group, a tertiary sulfonium group, an alkoxycarbonylamino group, a sulfonamide group, a carbamoyl group, a sulfamoyl group, a sulfonyl group, an alkoxycarbonyl group, a heterocyclicoxy group, an acyloxy group, a carbamoyloxy group, a silyl group, a silyloxy group, an aryloxycarbonylamino group, an imide group, a heterocyclicthio group, a sulfinyl group, an aryloxycarbonyl group, and an acyl group, and further combinations of these groups. Preferred are an alkyl group, an aryl group, an alkoxy group, an acyl group, an acyloxy group, an acylamino group, a sulfonamide group, a halogen atom, and a ureide group.

As preferred groups represented by $R_{23}$, cited are a hydrazino group or an amino group, and specifically preferred ones are an N',N'-di-substituted hydrazine group, an N'-acylhydrazine group, or an N'-carbamoylhydrazine.

Exemplified compounds represented by the general formula (2) are illustrated below, but the present invention is not limited thereto.

2-1′

$H_2NNHCONHNH_2$ 2-2′

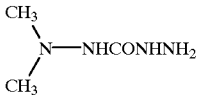

2-3′

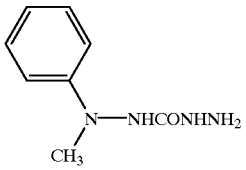

-continued 2-4′

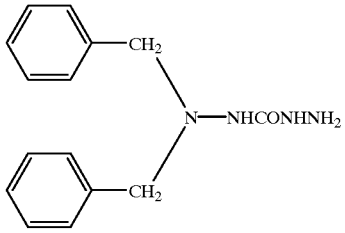

2-5

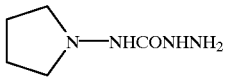

2-6

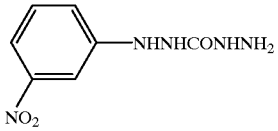

2-7

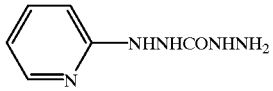

2-8

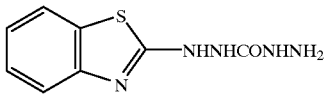

2-9

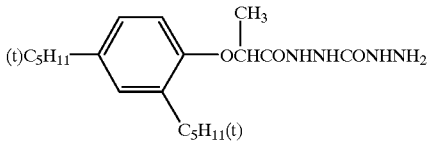

2-10

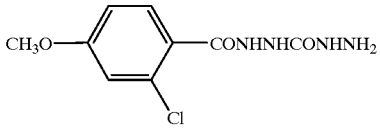

2-11

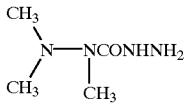

2-12

$n\text{-}C_8H_{17}SO_2NHNHCONHNH_2$ 2-13

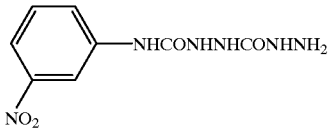

2-14

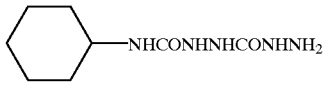

2-15

$H_2NCONHNH_2$ 2-16

$C_{16}H_{13}NHCONHNH_2$

-continued 2-17

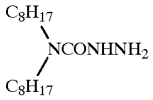

2-18

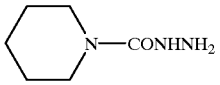

2-19

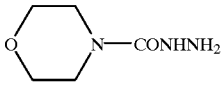

2-20

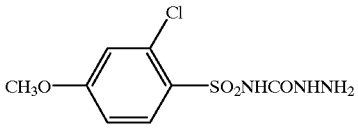

2-21

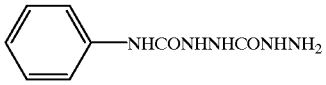

2-22

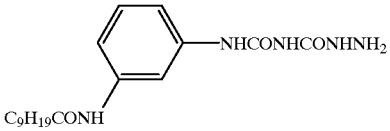

2-23

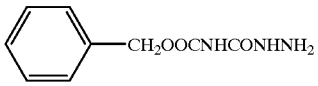

2-24

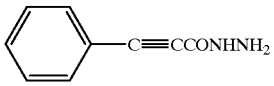

In the general formula (3), as an aliphatic group represented by $R_{33}$, are cited an alkyl group, an alkenyl group and an alkynyl group. Said alkyl group and alkynyl group are identical to those cited for $R_{23}$ of the general formula (2), and an alkenyl group having 2 to 18 carbon atoms is preferred, and that having 2 to 10 carbon atoms such as a vinyl group or a 2-styryl group is more preferred.

As an aromatic group represented by $R_{33}$, a mono ring or condensed ring aryl group having 6 to 24 carbon atoms, preferably 6 to 12 carbon atoms is cited, and for example, a phenyl group, a naphthyl group and p-methoxyphenyl group are preferred. As a heterocyclic group, said heterocyclic group may be a mono ring or condensed ring, and may be a saturated or unsaturated group having 1 to 5 carbon atoms and at least an oxygen atom, a nitrogen atom or a sulfur atom, and further said group may be a 5-membered or 6-membered ring group having at least a hetero atom, Number of hatero atom constituting said heterocyclic group may be single or plural. Examples of said heterocyclic group include a furyl group, a 2 thienyl group, a 4-pyridyl group, an imidazolyl group, a quinonyl group, an iso-quinonyl group, a benzimidazolyl group, a thiazolyl group, a benzothiazolyl group, a triazolyl group, a morpholino group, a piperidino group and a piperadinyl group.

As a group represented by $R_{33}$, having a nitrogen atom attached to $G_3$, are cited an acylamino group, an alkylamino group, an arylamino group and a heterocyclicamino group. Examples of an acylamino group include an acetamide group having 1 to 16 carbon atoms, preferably 1 to 10 carbon atoms, and p-chlorobenzoylamide group. As an alkylamino group, is cited an N,N-dimethylamino group having 1 to 16 carbon atoms, preferably 1 to 10 carbon atoms. As an arylamino group, is cited an anilino group having 6 to 24 carbon atoms, and as a heterocyclicamino group, 5-membered or 6-membered saturated or unsaturated heterocyclic group having 1 to 5 carbon atoms and at least a oxygen atom, a nitrogen atom or a sulfur atom such as a 2-oxazolylamino group, a 2-tetrahydroaranylamino group, and a 4-pyridylamino group.

As a group represented by $R_{33}$, having an oxygen atom attached to $G_3$, are cited an alkoxy group, an aryloxy group, a heterocyclicoxy group, an acyloxy group, and a carbamoyloxy group. As an alkoxy group having 1 to 16 carbon atoms, preferably 1 to 10 carbon atoms, are cited a methoxy group, 2-methoxyethoxy group, and as an aryloxy group, are cited a phenoxy group, a methoxyphenoxy group having 6 to 24 carbon atoms. As a heterocyclicoxy group, 5-membered or 6-membered saturated or unsaturated heterocyclic group having 1 to 5 carbon atoms and at least a oxygen atom, a nitrogen atom or a sulfur atom such as a 2-thiazoyloxy group, a 2-tetrahydropiranyloxy group, and a 2-pyridyloxy group. As an acyloxy group having 1 to 16 carbon atoms, preferably 1 to 10 carbon atoms, are cited an acetoxy group, a benzoyloxy group, and as a carbamoyloxy group having 1 to 16 carbon atoms, preferably 1 to 10 carbon atoms, are cited an N,N-dimethylcarbamolyloxy group, an N-hexylcarbamoyloxy group, and an N-phenylcarbamoyloxy group.

Exemplified compounds represented by the formula (3) are shown below, but the present invention is not limited thereto.

3-1′

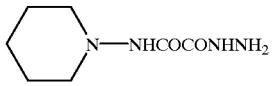

3-2′

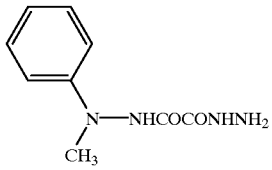

3-3′

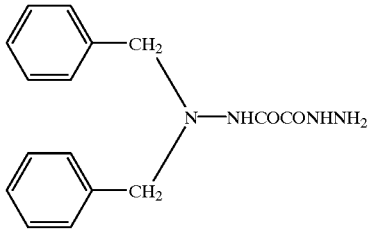

3-4′

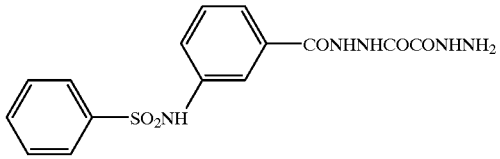

-continued
3-5
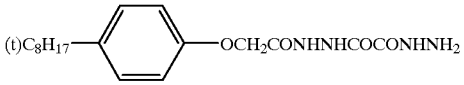
3-6
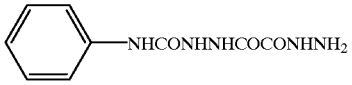
3-7
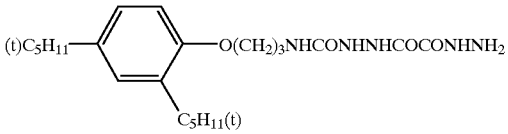
3-8
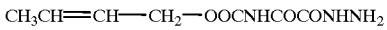
3-9
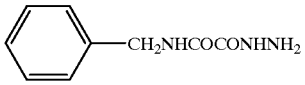
3-10
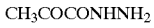
3-11
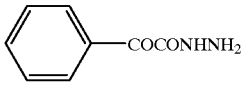
3-12
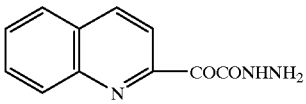
3-13
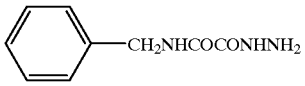
3-14
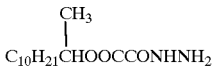
3-15
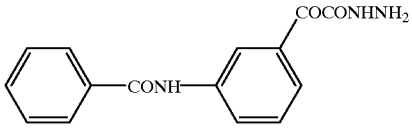
3-16
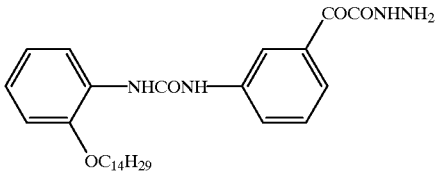
3-17
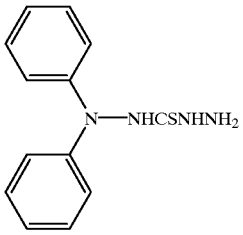
-continued
3-18
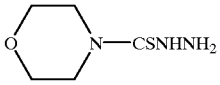
3-19
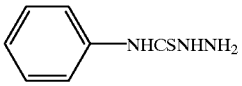
3-20
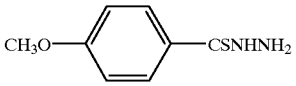
3-21
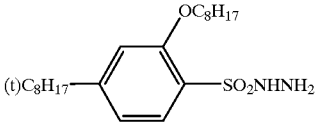
3-22
3-23
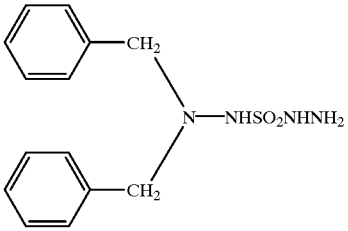
3-24
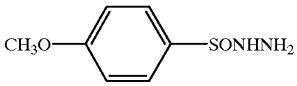
3-25
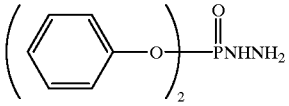
3-26
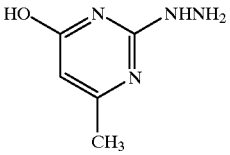
3-27
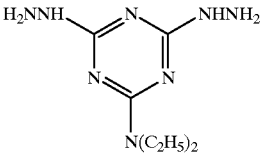
3-28
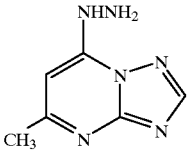

-continued 3-29

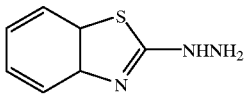

The compounds represented by the formula (2) or formula (3) may contain a so-called ballast group or polymer moiety. These compound can be synthesized by methods described in "Organic Functional Group Preparations", (edited by S. R. Sandler and W. Karo, published by Academic Press NY), vol. I, on pages 363 through 386, or by methods described in literatures cited in the above-mentioned literature.

A hydrazine derivative addition layer is a photosensitive layer containing a silver halide emulsion, namely an image forming layer and/or a photographic component layer adjacent to the photosensitive layer. The added amount is preferably in the range of $10^{-6}$ to $10^{-1}$ mole per mole of silver halide and is most preferably in the range of $10^{-5}$ to $10^{-2}$ mole, though the optimum amount is not defined, depending on the silver halide grain size, halide composition, chemical sensitization degree, reducing agent type, retarder type, etc.

The thermally developable material preferably contains a high contrast accelerating agent such as a hydroxyl amine compound, an alkanol amine compound, or an ammonium phthalate compound described in U.S. Pat. No. 5,545,505, a hydroxamic acid compound described in U.S. Pat. No. 5,545,507, an N-acyl-hydrazine compound described in U.S. Pat. No. 5,558,983, an acrylonitrile compound described in U.S. Pat. No. 5,545,515, and a hydrogen donating compound such as benzhydrol, di-phenylphosphine, di-alkylpiperidine and alkyl-β-ketoester. Of these, a quaternary onium compound represented by the formula (P), and an amino compound represented by the following formula [Na] are preferably used.

General formula (P)

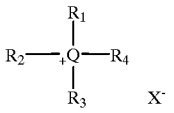

wherein Q represents a nitrogen atom or a phosphorous atom; $R_1$, $R_2$, $R_3$, and $R_4$ each represents a hydrogen atom or a substituent, and $X^-$ represent an anion. Furthermore, $R_1$ to $R_4$ may link with each other to complete a ring.

Formula [Na]

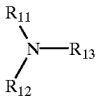

wherein $R_{11}$, $R_{12}$, $R_{13}$ each represent a hydrogen atom, an alkyl group, a substituted alkyl group, an alkenyl group, a substituted alkenyl group, an alkynyl group, an aryl group, a substituted aryl group, or a saturated or unsaturated heterocyclic group. $R_{11}$, $R_{12}$, and $R_{13}$ may form a ring with each other. Preferred compound represented by the formula [Na] is a tertiary amine compound. The compounds represented by the formula [Na] preferably contains a nondiffusion group or a silver halide adsorption group in a molecule. In order to make these compounds nondiffusible, a molecular weight of these compounds is preferably not less than 100, and is more preferably lot less than 300. Examples of said nondiffusion group include the same nondiffusion groups as those cited for $A_0$ of the formula [H]. Further, examples of preferred silver adsorption group include a heterocyclic groups, a mercapto groups, thioether groups, a thione groups, and thiourea groups, etc.

As more preferred nucleation accelerating agent than the nucleation agent represented by [Na], is cited a nucleation agent represented by the following formula [Na2]

Formula [Na2]

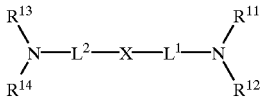

wherein $R^{11}$, $R^{12}$ $R^{13}$ and $R^{14}$ each represent a hydrogen atom, an alkyl group, a substituted alkyl group, an alkenyl group, a substituted alkenyl group, an alkynyl group, an substituted alkynyl group, an aryl group, a substituted aryl group, or a saturated or an unsaturated heterocyclic group. $R_{11}$, $R_{12}$, $R_{13}$ and $R_{14}$ may form a ring with each other. Further, $R_{11}$, $R_{12}$, $R_{13}$ and $R_{14}$ are concurrently not a hydrogen atom. X represent an atom selected from a group consisting of S, Se and Te. $L^1$ and $L^2$ each represent a divalent linking group. Examples of said linking group include the following groups detailed below and the following groups having a appropriate substituent (for example, an alkylene group, an alkenylene group, an allylene group, an acylamino group, and a sulfonamide group, etc.). —$CH_2$—, —CH═CH—, —$C_2H_4$—, pyridine-di-yl, —N($Z_1$)— ($Z_1$ represents a hydrogen atom, an alkyl group, and an aryl group), —)—, —S—, —(CO)—, —$SO_2$—, —$CH_2N$—.

Further, the linking group represented by $L^1$ or $L^2$ preferably contains at least a group represented by the following structure in said linking group.

—[$CH_2CH_2O$]—, —[C ($CH_3$)$HCH_2O$]—, —[OC($CH_3$)$HCH_2O$]—, —[$OCH_2C$(OH)$HCH_2$]—.

Exemplified nucleation accelerating agents represented by formula [Na] or [Na2] are illustrated below.

Na-1

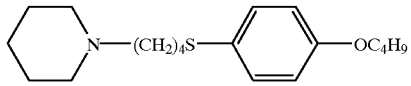

Na-2

$[(C_3H_7)_2N(CH_2)_3OCH_2CH_2]_2S$

Na-3

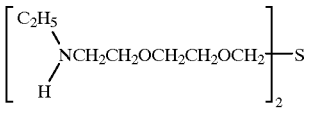

Na-4

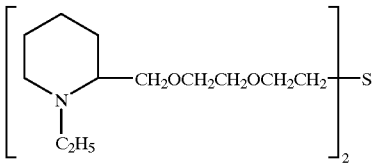

-continued

Na-5

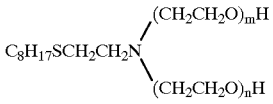

m + n = 20

Na-6

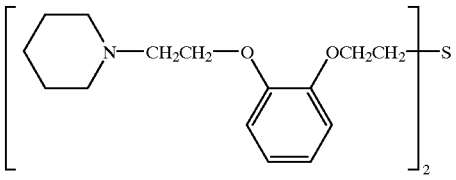

Na-7

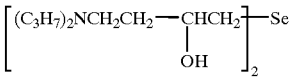

Na-8

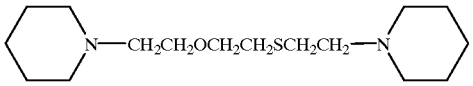

Na-9

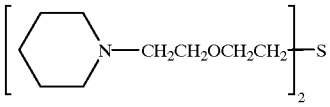

Na-10

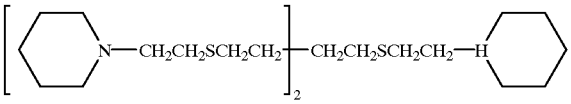

Na-11

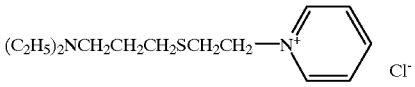

Na-12

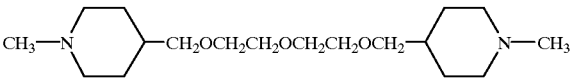

Na-13

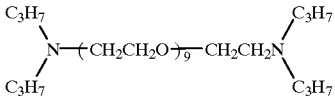

Na-14

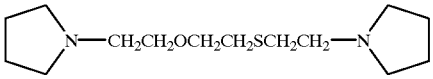

Na-15

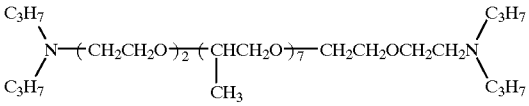

Na-16

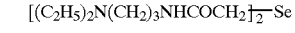

Na-17

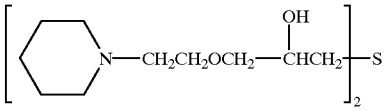

-continued

Na-18

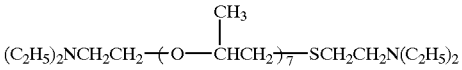

Na-19

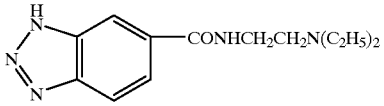

Na-20

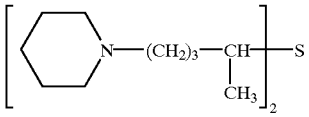

Na-21

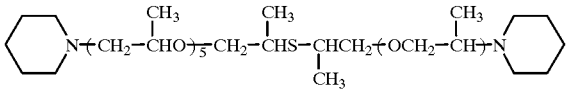

Na-22

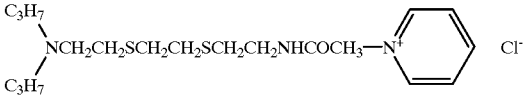

The quaternary onium compounds employed in the present invention are those having a nitrogen or phosphorous atom quaternary cationic group in the molecule.

In formula (P). substituents represented by $R_1$ to $R_4$ include an alkyl group (for example, a methyl group, an ethyl group, a propyl group, a butyl group, a hexyl group, a cyclohexyl group, etc.), an alkenyl group (for example, an allyl group, a butenyl group, etc.), an alkynyl group (for example, a propagyl group, a butynyl group, etc.), an aryl group (for example, a phenyl group, a naphthyl group, etc.), a heterocyclic group (for example, a piperidinyl group, a piperadinyl group, a morpholinyl group, a piridyl group, a furyl group, a thienyl group, a tetrahydrofuryl group, a tetrahydrothienyl group, a sulforanyl group, etc.), and an amino group etc. Rings which can be completed by linking $R_1$, $R_2$, $R_3$, and $R_4$ with each other include a piperidine ring, a morpholine ring, a piperadine ring, a quinuclidine ring, a pyridine ring, etc.

Groups represented by $R_1$ to $R_4$ may have substituents such as a hydroxyl group, an alkoxy group, an aryloxy group, a carboxyl group, a sulfo group, an alkyl group, an aryl group, etc.

As $R_1$ $R_2$, $R_3$, and $R_4$, a hydrogen atom and an alkyl group are preferred.

Anions represented by $X^-$ include inorganic or organic anions such as a halogen ion, a sulfate ion, a nitrate ion, an acetate ion, a p-toluenesufonate ion, etc.

More preferred compounds are those represented by the following general formulas (Pa), (Pb), or (Pc) and the following general formula (T).

Formula (Pa)

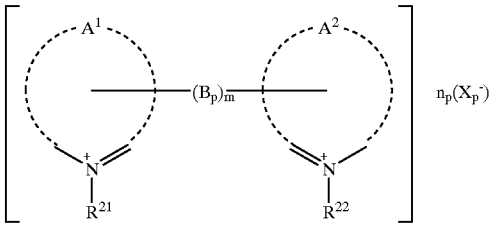

Formula (Pb)

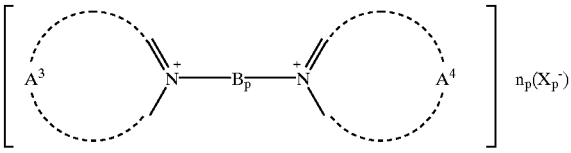

Formula (Pc)

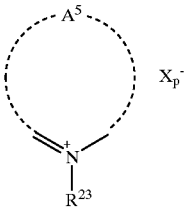

wherein $A_1$, $A_2$, $A_3$, $A_4$, and $A_5$ each represents a metal-free atom group to complete a nitrogen-containing heterocyclic ring; may contain an oxygen atom, a nitrogen atom, or a sulfur atom; and may be condensed with a benzene ring. Heterocyclic rings completed by $A_1$, $A_2$, $A_3$, $A_4$, and $A_5$ may have substituents which may be the same or different. Substituents include an alkyl group, an aryl group, an aralkyl group, an alkenyl group, an alkynyl group, a halogen atom, an acyl group, an alkoxycarbonyl group, an aryloxycarbonyl group, a sulfo group, a carboxy group, a hydroxyl group, an alkoxy group, an aryloxy group, an amid group, a sulfamoyl group, a carbamoyl group, a ureido group, an amino group, a sulfonamide group, a sulfonyl group, a cyano group, a nitro group, a mercapto group, an alkylthio group, and an arylthio group. Cited as preferred examples of $A_1$, $A_2$, $A_3$, $A_4$, and $A_5$, can be 5- and 6-membered rings (each of pyridine, imidazole, thiozole, oxazole, pyrazine, pyrimidine rings, etc.) and cited as a more preferred example, is a pyridine ring.

$B_p$ represents a divalent linking group and m represents 0 or 1. As divalent linking groups, cited can be an alkylene group, an arylene group, an alkenylene group, —$SO_2$—, —SO—, —O—, —CO—, —N($R_6$)— ($R_6$ represents an alkyl group, an aryl group or a hydrogen atom), or those formed in combinations thereof. Cited as preferred examples of $B_p$, can be cited an alkylene group and an alkenylene group.

$R^{21}$, $R^{22}$ and $R^{25}$ each represents an alkyl group having from 1 to 20 carbon atoms and $R_1$ and $R_2$ may be the same or different. Alkyl groups as described herein represent substituted or unsubstituted alkyl groups. The substituents are the same as those listed for $A_1$, $A_2$, $A_3$, $A_4$, and $A_5$.

The preferred example of each of $R^{21}$, $R^{22}$, and $R^{23}$ is an alkyl group having from 4 to 10 carbon atoms. The more preferred example includes a substituted or unsubstituted aryl-substituted alkyl group.

$X_p^-$ represents a counter ion necessary for balancing the total charge of a molecule, for example, a chlorine ion, a bromine ion, an iodine ion, a nitrate ion, a sulfate ion, p-toluenesulfonate, oxalate, etc. $n_p$ represents the number of counter ions necessary for balancing the total charge of a molecule, and in the case of an internal salt, $n_p$ is 0.

General formula (T)

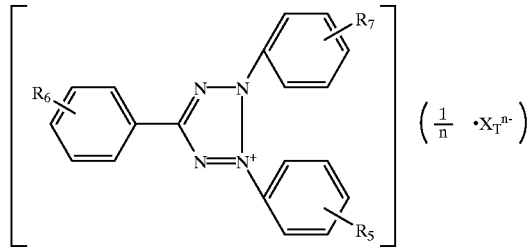

Substituents $R_5$, $R_6$, and $R_7$ of the phenyl group of tripenyltetrazolium compounds represented by the above-mentioned general formula (T) preferably represent hydrogen atoms or those having a negative Hammett sigma value (σP), indicating electron withdrawing capability.

The Hammett sigma values in phenyl groups can be found in many publications such as, for example, C. Hansch report cited in Journal of Medical Chemistry, Volume 20, page 304, 1977, etc. Groups having preferred negative sigma values include, for example, a methyl group (σP=−0.17, hereinafter, each value in parentheses shows a σP value), an ethyl group (−0.15), a cyclopropyl group (−0.21), a n-propyl group (−0.13), an iso-propyl group (−0.15), a cyclobutyl group (−0.15), a n-butyl group (−0.16), an iso-butyl group (−0.20), a n-pentyl group (−0.15), a cyclohexyl group (−0.22), an amino group (−0.66), an acetylamino group (−0.15), a hydroxyl group (−0.37), a methoxy group (−0.27), an ethoxy group (−0.24), a propoxy group (−0.25), a butoxy group (−0.32), a pentoxy group (−0.34), etc., all of which are useful as substituents of the compounds represented by general formula (T).

n represents 1 or 2. Anions represented by $X_T^{n-}$ include, for example, halide ions such as a chloride ion, a bromide ion, an iodide ion, etc.; inorganic acid radicals such as nitric acid, sulfuric acid, perchloric acid, etc.; organic acid radicals such as sulfonic acid, carboxylic acid, etc.; anionic surface active agents, specifically lower alkylbenzene sulfonic acid anions such as a p-toluenesulfonic acid anion, etc., higher alkylbenzenesulfonic acid anions such as a p-dodecylbenzenesulfonic acid anion, etc., higher alkylsulfate ester anions such as a laurylsulfate anion, etc., boric acid series anions such as tetraphenylboron, etc., dialkylsulfosuccinate anions such as a di-2-ethylhexylsulfosuccinate anion, etc., higher fatty acid anions such as a cetylpolyethenoxysulfate anion, etc., polymers of polyacrylic acid anion attached with an acid radical, etc.

Specific examples of quaternary onium compounds are described below. However, the present invention is not limited to these examples.

P-1
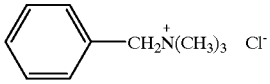
P-2
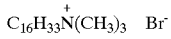
P-3
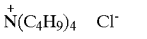
P-4
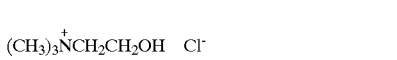
P-5
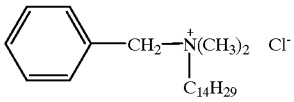
P-6
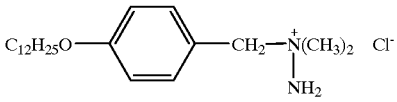
P-7
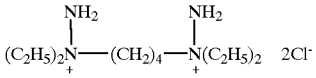
P-8
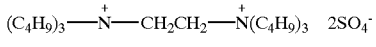
P-9
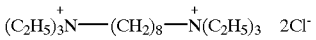
P-10
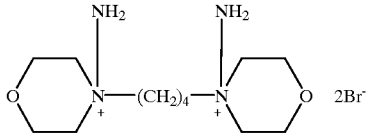
P-11
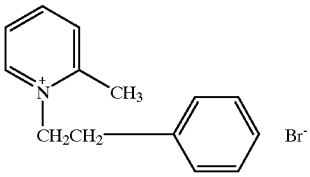
P-12
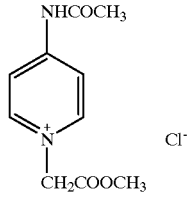
P-13
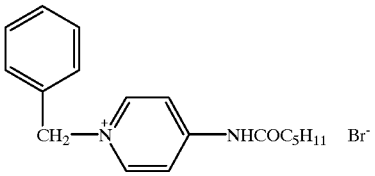
P-14
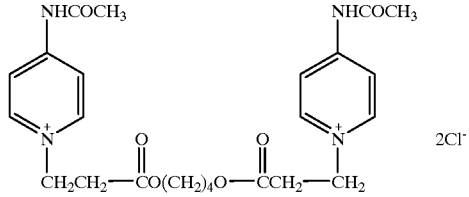
P-15
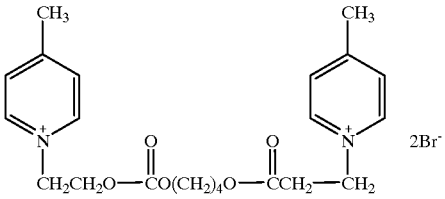
P-16
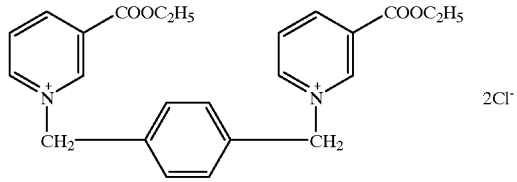
P-17
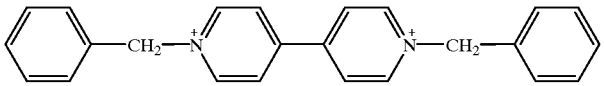
P-18
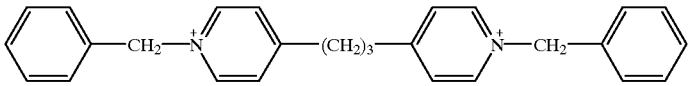
P-19
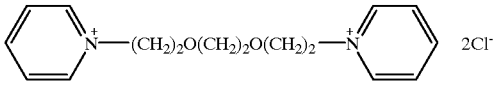
P-20
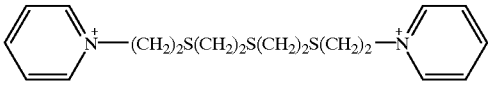

-continued
P-21
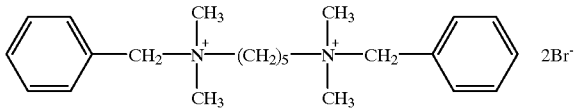
P-22
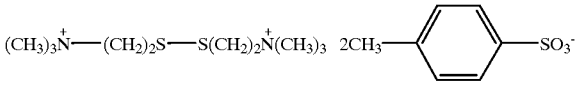
P-23
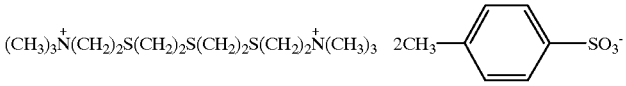
P-24
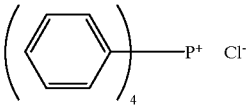
P-25
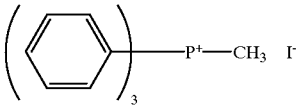
P-26
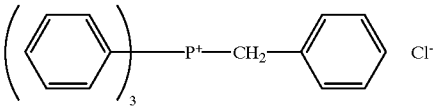
P-27
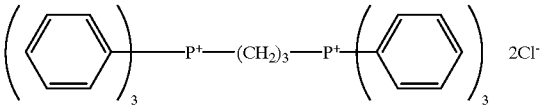
P-28
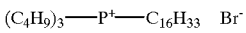
P-29
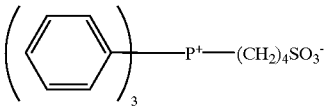
P-30
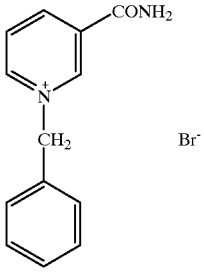
P-31
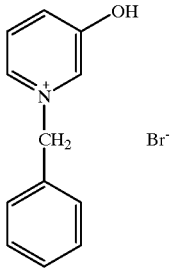
P-32
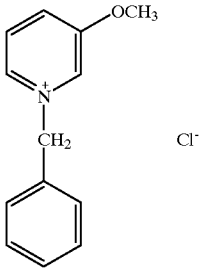
P-33
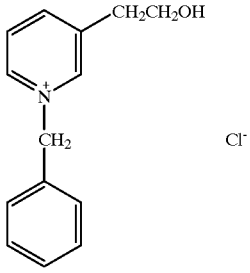

-continued
P-34
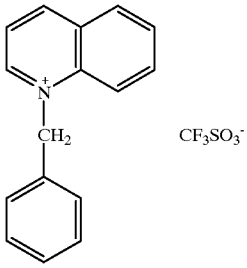
P-35
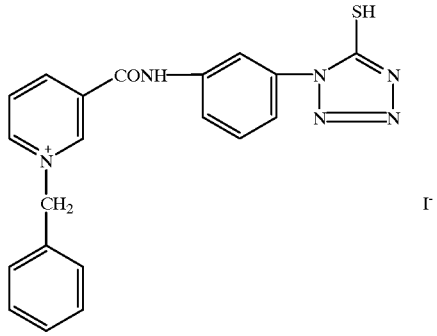
P-36
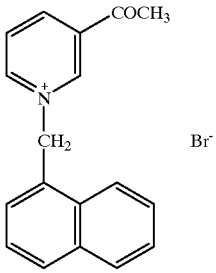
P-37
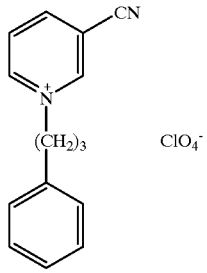
P-38
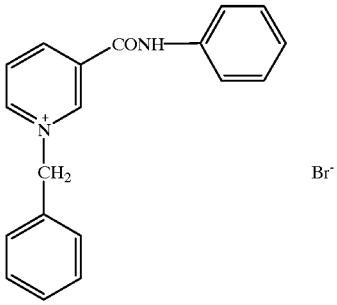
P-39
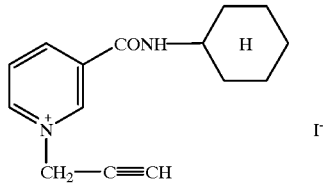
P-40
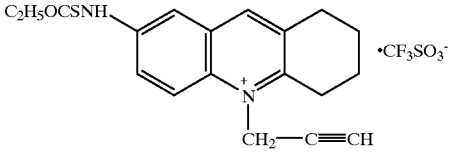
P-41
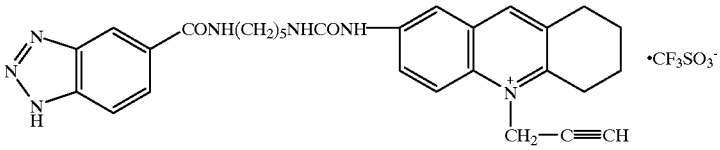
P-42
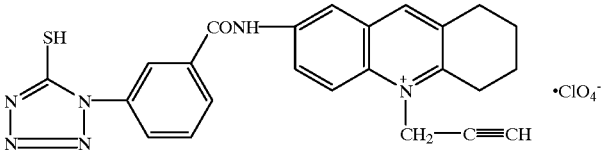

-continued
P-43
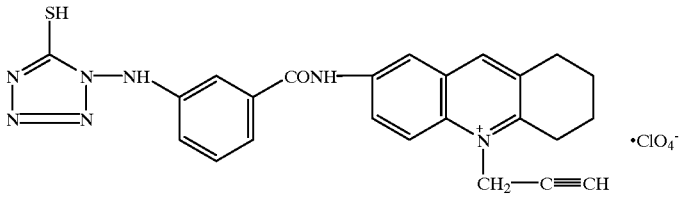
P-44
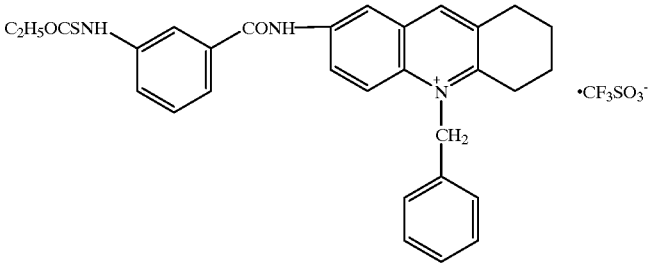
P-45
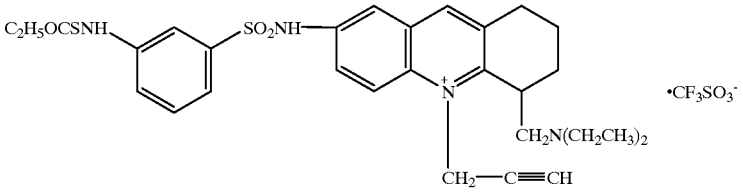
P-46
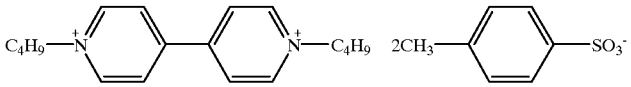
P-47
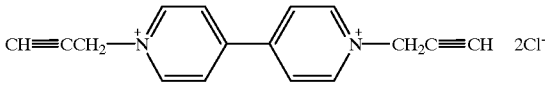
P-48
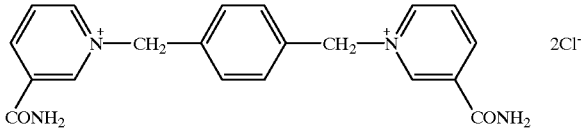
P-49
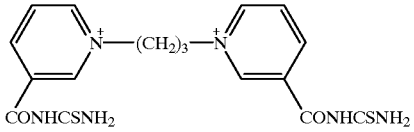
P-50
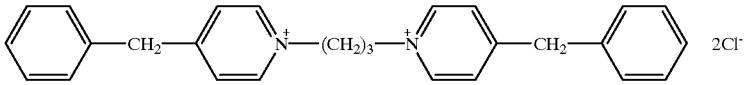
P-51
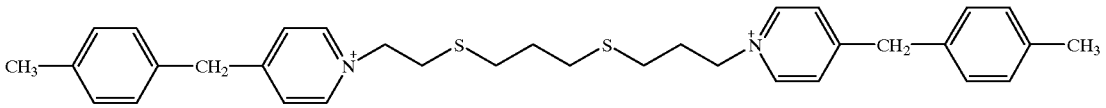
P-52
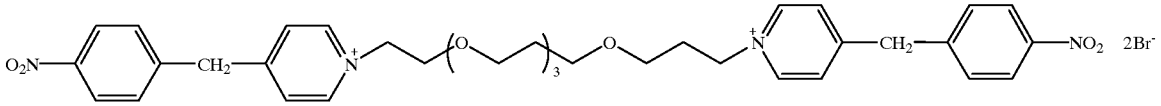

-continued

P-53

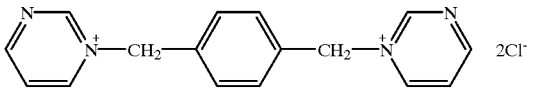

P-54

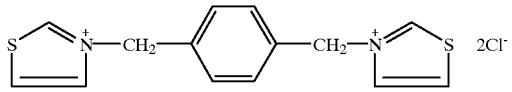

P-55

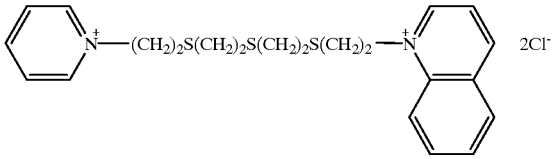

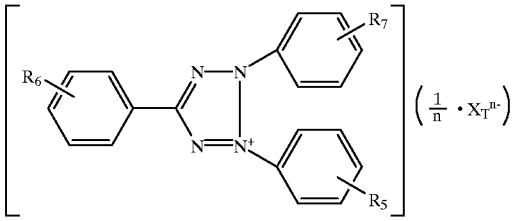

| Compound No. | $R_1$ | $R_2$ | $R_3$ | $X_T^{n-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$C_2H_5$ | H | p-$OC_2H_5$ | $Cl^-$ |
| T-13 | p-$CH_3$ | H | p-iso$C_5H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

The above-mentioned quaternary onium compounds can readily be synthesized employing the known method. For example, the above-mentioned tetrazolium compounds can be synthesized referring to a method described in Chemical Reviews 55, pages 335 to 483.

The added amount of the quaternary compound is preferably between $1\times10^{-8}$ and about 1 mole per mole of silver halide, and is more preferably between $1\times10^{-7}$ and $1\times10^{-1}$ mole. These can be added to a photosensitive material at any arbitrary time, from the silver halide grain formation to the actual coating.

The quaternary onium compounds may be employed individually or in combination of two or more, and may be added to any layer of the photosensitive material component layers. However, these are preferably added to at least one component layer on the side having the photosensitive layer and are more preferably added to a photosensitive component layer, namely, an image forming layer and/or a layer an adjacent to the photosensitive component layer.

Exposure to the thermally developable photosensitive material of the present invention is preferably carried out using an Ar ion laser (488 nm), a He—Ne laser (633 nm), a red color semiconductor laser (670 nm), an infrared semiconductor laser (760 nm, 780 nm and 820 nm), etc. The infrared semiconductor laser is preferably employed in view of high power, transparency of the photosensitive material or so.

The exposure is preferably conducted by laser scanning exposure. In this occasion it is preferable to employ an exposing apparatus that the angle formed between the surface of the photosensitive material and laser light is not substantially perpendicular during exposure. The angle is preferably 55–88°, more preferably 60–86°, further preferably 65–84°, and most preferably 70–82°.

The exposure is preferably conducted by laser scanning exposure. In this occasion it is preferable to employ an exposing apparatus that the angle formed between the surface of the photosensitive material and laser light is not substantially perpendicular during exposure. The angle is preferably 55–88°, more preferably 60–86°, further preferably 65–84°, and most preferably 70–82°.

Spot diameter of the laser beam when scanning on the photosensitive material is preferably not more than 200 μm, and is more preferably not more than 100 μm. The smaller spot diameter is preferable because of reducing the angle difference from perpendicular point of angle of incidence.

The lower limit of the spot diameter of the laser beam is about 10 μm. By employing such a laser scanning exposure, image deterioration such as mottle of interference stripes caused by reflecting light when exposed by laser scanning can be reduced.

It is also Preferable to employ an laser scanning exposure apparatus which emit longitudinal multiple mode scanning laser light. In this occasion image deterioration such as mottle of interference stripes can be reduced in comparison with longitudinal single mode laser light.

To make the light longitudinally multiple, a method is employed such as synthesizing waves, employing returning light, superposing high frequency wave. The longitudinally multiple light means that the exposure wave length is not simple, and has distribution of wavelength of not less than 5 nm, preferably 10 nm. The upper limit of the distribution of wavelength is specifically not limited, but is usually about 60 nm.

When a laser image setter, in which an exposing apparatus and a thermal developer are integrated, is employed for exposure and thermal development, a transportation pathway is relatively long so that transportation problems often tend to occur. However, even when said laser image setter is employed, according to use of a thermally developable material of the present invention, no transportation problem can be attained and an excellent process can be provided.

Namely, when the thermally developable material of the present invention is processed with the laser image setter, more excellent performance can be obtained.

EXAMPLES

The present invention is explained with reference to specific examples below. However, the present invention is not limited to these examples.

Example 1

Preparation of a polyethylene Terephthalate (PET) Support

PET pellets were dried at 130 ° C. over a period of 4 hours, after which, said pellets were melted at 300° C. The thus melted PET was extruded from a T-type die and cooled down rapidly. Thus, a non-stretched PET film was produced. The thus obtained PET film was stretched 3.0 times as long as the original length in a length direction at 110° C., employing plural rollers of which circumferential rates were different from one another, after which, the thus treated PET film was stretched 4.5 times as wide as the original width in a width direction at 130° C., employing a tenter. After then, the thus treated PET film was fixed over a period of 20 sec. at 240° C., after which, 4% of the thus treated PET film was relieved at 240° C. After that, portions of the PET film which the tenter clipped were slit, after which, both ends of the PET film were subjected to a knurl treatment, and the thus treated PET film was wound up at 4 kg/cm$^2$. Thus, a PET film having 2.4 m width, 800 m length, and 125 $\mu$m thickness was obtained. A glass transition temperature of said PET film was 79° C.

Both surfaces of the resulting PET film, being biaxially stretched and having 125 $\mu$m thickness, were subjected to a corona discharge at 8 w/m$^2$·min., after which, onto one side of said surfaces was coated the following sublayer coating solution a-1 so that a dry thickness of the sublayer was 0.8 $\mu$m. Thus, the sublayer A-1 was obtained. Further, onto an opposite surface side was applied the following sublayer coating solution b-1, having an antistatic property, so that a dry thickness of the sublayer was 0.8 $\mu$m. Thus, the antistatic sublayer B-1 was obtained.

| (Coating solution of sublayer a-1) | |
|---|---|
| Butyl acrylate (30 weight %) (being copolymer latex solution consisting of t-butyl acrylate (20 wt %), styrene (25 wt %), and 2-hydroxyethyl acrylate (25 wt %); solid components content being 30 wt %) | 270 g |
| (C-1) | 0.6 g |
| Hexamethylene-1, 6-bis (ethyleneurea) | 0.8 g |
| Fine polystyrene particles (average particle size being 3 $\mu$m) | 0.05 g |
| Colloidal silica (average particle size being 90 $\mu$m) | 0.1 g |
| Water was added to make 1 liter in total. | |
| (Coating solution of sublayer b-1) | |
| $SnO_2$/Sb (being 9/1 by weight ratio, average particle size being 0.18 $\mu$m) | coated amount being adjusted to 200 mg/m$^2$ |
| Butyl acrylate (30 weight %) (being copolymer latex solution consisting of styrene (20 wt %) and glycidyl acrylate (40 wt %); solid components content being 30 wt %) | 270 g |
| (C-1) | 0.6 g |
| Hexamethylene-1, 6-bis (ethyleneurea) | 0.8 g |

Water was added to make 1 liter in total.

Subsequently, both surfaces of the sublayer A-1 and sublayer B-1 were subjected to a corona discharge at 8 w/m$^2$·min., after which, onto the sublayer A-1 was applied the following upper sublayer coating solution a-2, so that an upper sublayer A-2 having 0.1 $\mu$m dry thickness was obtained. Onto the sublayer B-1 was applied the following upper sublayer coating solution b-2, so that an upper sublayer B-2, having 0.8 $\mu$m dry thickness and an antistatic property, was obtained.

| (Coating solution of upper sublayer a-2) | |
|---|---|
| Gelatin | coated amount being adjusted to 0.4 g/m$^2$ |
| (C-1) | 0.2 g |
| (C-2) | 0.2 g |
| (C-3) | 0.1 g |
| Silica particles (average particle size being 3 $\mu$m) | 0.1 g |

Water was added to make 1 liter in total.

| (Coating solution of upper sublayer b-2) | |
|---|---|
| (C-4) | 60 g |
| Latex solution consisting of (C-5) (solid component content being 20 wt %) | 80 g |
| Ammonium sulfate | 0.5 g |
| (C-6) | 12 g |
| Polyethylene glycol (weight average molecular weight being 600) | 6 g |

Water was added to make 1 liter in total.

The thus produced PET support comprising sublayers on both sides was placed in a heat treatment zone, regulated at 160° C., having 30 m transportation length, and transported at 14 g/cm$^2$ tention, and at 15 m/min. transporting rate, after which, said PET support was transported in a 40° C. zone over a period of 15 sec. and finally wound up at 10 kg/cm$^2$ winding tention.

(C-1)

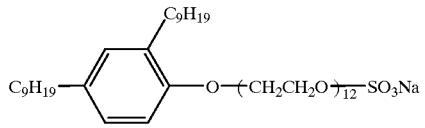

(C-2)

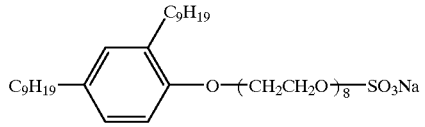

(C-3)

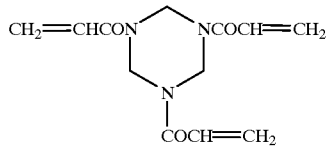

-continued (C-4)

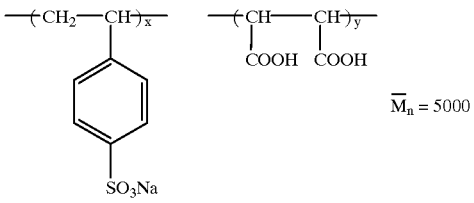

$\overline{M}_n = 5000$ ($\overline{M}n$ is number average molecular weight)

x:y = 75:25 (weight ratio)

(C-5)

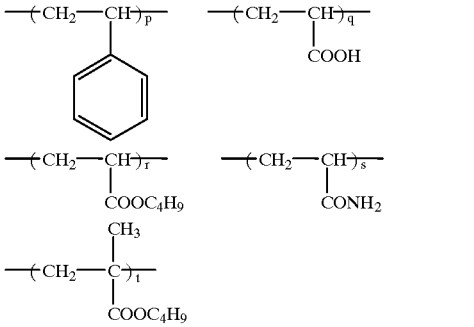

p:q:r:s:t = 40:5:10:5:40 (weight ratio)

(C-6)

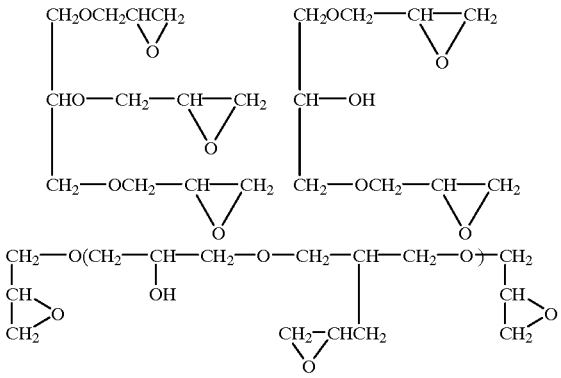

Mixture of three compounds above

Preparation of Emulsion A

In 900 ml of water, 7.5 g of inert gelatin and 10 mg of potassium bromide were dissolved. After adjusting the temperature to 35° C. and the pH to 3.0, 370 ml of an aqueous solution containing 74 g of silver nitrate, an aqueous solution containing potassium bromide and potassium iodide in a mole ratio of 98/2, $1\times10^{-6}$ mole of $Ir(NO)Cl_6$ salt per mole of silver, and $1\times10^{-6}$ mole of rhodium chloride salt per mole of silver were added employing a controlled double-jet method while maintaining the pAg at 7.7. After that, the thus obtained solution was subjected to reduction sensitization while maintaining the pH at 8.7 and the pAg at 6.5 respectively. Subsequently, 4-hydroxy-6-methyl-1,3,3a,7-tetraazaindene was added and the pH was adjusted to 5 using NaOH. Thus, obtained was cubic silver iodobromide grains having an average grain size of 0.06 μm, a monodispersibility of 10 percent, a projection diameter area variation coefficient of 8 percent, and a [100] plane ratio of 87 percent. The resulting emulsion was subjected to desalting through coagulation precipitation employing an coagulant. After that, 0.1 g of phenoxyethanol was added, and the pH and pAg were adjusted to 5.9 and 7.5 respectively, to obtain a silver halide emulsion.

Preparation of a Sodium Behenate Solution 32.4 g of behenic acid, 9.9 g of arachidinic acid and 5.6 g of stearic acid were dissolved in 945 ml of deionized water at 90° C. To the thus obtained solution was added 98 ml of 1.5 M of sodium hydroxide aqueous solution while stirred at high speed. Subsequently, added to the solution obtained above was 0.93 ml of concentrated nitric acid, and after which the solution was cooled to 55° C. and stirred for 30 min. so as to obtain the sodium behenate solution.

Preparation of a Preformed Emulsion Derived from the Silver Behenate solution and the Silver Halide Emulsion A To the sodium behenate solution obtained above was added 15.1 g of the silver halide emulsion A as prepared above, after which the pH of the thus obtained solution was adjusted to 8.1, employing sodium hydroxide aqueous solution, and to the thus obtained solution was slowly added 147 ml of 1 M of nitric acid aqueous solution over a period of 7 min. After the thus obtained solution was stirred for an additional 20 min., water-soluble salts were removed by employing an ultrafiltration method. Thus, obtained was silver behenate having an average particle size of 0.8 μm, and a monodispersibility of 8 percent. Dispersion blocks were then formed, after which water was removed from said dispersion blocks and further, water washing and water removal were carried out 6 more times, after which said dispersion blocks were dried.

Preparation of a Photosensitive Emulsion

To the thus obtained preformed emulsion were slowly added 544 g of methyethyl ketone solution containing polyvinyl butyral (containing polyvinyl butyral in an amount of 17 wt %, at an average molecular weight of 3000), and 107 g of toluene, after which the thus obtained solution was sufficiently blended and dispersed at 4000 psi.

Coating of a Backing Layer Side

A backing layer coating solution consisting of the following composition was applied on a support employing an extrusion coater so as to obtain a wet thickness of 30 μm, after which the coating was then dried at 60° C. for 3 min.

| (Backing layer coating solution 1) | |
|---|---|
| Cellulose acetatebutylate (10% methylethyl ketone solution) | 15 ml/m² |
| Dye-B | 7 mg/m² |
| Matting agent (monodispersed silica having a monodispersibility of 15%, and an average particle size of 8 μm) | 30 mg/m² |

Dye-B

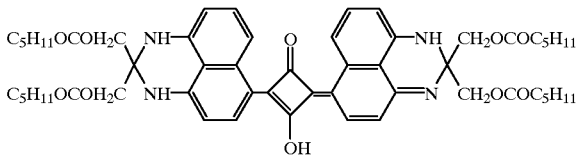

Coating of a Photosensitive Layer Side

A photosensitive layer coating solution consisting of the following composition, as well as a protective layer coating solution also shown in the following composition, to be coated on said photosensitive layer coating solution, were simultaneously applied on a support surface on the opposite side of the backing layer employing an extrusion coater at a coating rate of 20 m/min. with the amount of coated silver adjusted to 2.4 g/$m^2$. After coating, said coated photosensitive layer and protective layer were dried at 55° C. for 15 min.

| (Photosensitive layer coating solution) | |
|---|---|
| Preformed emulsion | 240 g |
| Sensitizing dye-1 (0.1% methanol solution) | 1.7 ml |
| Pyridiniumbromideperbromide (6% methanol solution) | 3 ml |
| Potassium bromide (0.1% methanol solution) | 1.7 ml |
| Hexamethylene diisocyanate (10% methanol solution) | 3 ml |
| 2-(4-chlorobenzoyl)benzoic acid (12% methanol solution) | 9.2 ml |
| 2-mercaptobenzimidazole (1% methanol solution) | 11 ml |
| Tribromomethylsulfoquinoline (5% methanol solution) | 17 ml |
| Developer-1 (20% methanol solution) | 29.5 ml |
| Phthalazine | 0.6 g |
| 4-methylphthalic acid | 0.25 g |
| Tetrachlorophthalic acid | 0.2 g |

Sensitizing dye-1

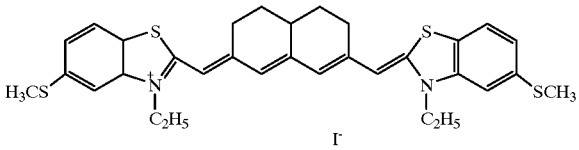

Developer-1

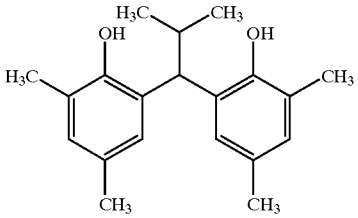

Surface Protective Layer Coating Solution 1

| | |
|---|---|
| Acetone | 5 ml/$m^2$ |
| Methylethyl ketone | 21 ml/$m^2$ |
| Polymer latex | weight as shown in Table 1 |
| Cellulose acetatebutylate | 2.3 g/$m^2$ |
| Methanol | 7 ml/$m^2$ |
| Phthalazine | 250 mg/$m^2$ |
| $CH_2{=}CHSO_2CH_2CH_2OCH_2CH_2SO_2CH{=}CH_2$ | 35 mg/$m^2$ |
| $C_9H_{17}O\text{-}C_6H_4\text{-}SO_3Na$ | 0.5 mg/$m^2$ |

Further, employed as a matting agent, was combined usage of 10 mg/$M^2$ of monodispersed silica particles having a monodispersibility of 10% and an average particle size of 3 $\mu$m, with 20 mg/$M^2$ of spherical PMMA particles having an average particle size of 5 $\mu$m.

Transportation Test 100 sheets of the thus obtained thermally developable photosensitive materials were exposed to an imager having a 810 nm semiconductor laser and were thermally and continuously developed at 115° C. for 15 sec employing an automatic developing processor incorporating a heat drum, after which transportation failures were noted.

Evaluation of Roller Marks After Thermal Development

After thermal development, roller marks on the photosensitive layer side of the photosensitive material were evaluated. Samples with no observed roller mark were given a rating of [10]; samples with observed roller marks, but which are still allowable for practical use, under specific conditions of compromise, were given a rating of [5], being the lowest allowable level; samples with roller marks observed over all the surface of the photosensitive material were given a rating of [1], and thus a 10 step evaluation method was employed.

The obtained results are shown in Table 1. In Table 1, P of P/B is the amount of polymer latex contained in a unit area, while B of P/B is the total amount of polyvinyl butyral contained in the photosensitive layer, cellulose acetatebutylate contained in the backing layer, and celluloseacetate butylate contained in the surface protective layer.

TABLE 1

| Sample No. | Polymer latex | Amount ratio P/B | Tg ° C. | ST g | Roller marks | Transportation failure number/100 sheets | Remarks |
|---|---|---|---|---|---|---|---|
| 1 | — | | | 120 | 8 | 20 | Comp. |
| 2 | Comp.(a) | 0.2 | 62 | 115 | 8 | 18 | Comp. |
| 3 | L-1 | 0.01 | −21 | 95 | 10 | 18 | Comp. |
| 4 | L-1 | 0.2 | −21 | 55 | 9 | 0 | Inv. |
| 5 | L-1 | 0.8 | −21 | 15 | 3 | 8 | Comp. |
| 6 | L-14 | 0.01 | 6 | 110 | 10 | 16 | Comp. |
| 7 | L-14 | 0.04 | 6 | 70 | 9 | 2 | Inv. |
| 8 | L-14 | 0.15 | 6 | 60 | 9 | 0 | Inv. |
| 9 | L-14 | 0.7 | 6 | 20 | 4 | 10 | Comp. |
| 10 | L-17 | 0.01 | 3 | 100 | 10 | 14 | Comp. |
| 11 | L-17 | 0.2 | 3 | 70 | 9 | 0 | Inv. |
| 12 | L-17 | 0.4 | 3 | 45 | 9 | 0 | Inv. |
| 13 | L-17 | 0.9 | 3 | 15 | 4 | 10 | Comp. |

TABLE 1-continued

| Sample No. | Polymer latex | Amount ratio P/B | Tg ° C. | ST g | Roller marks | Transportation failure number/100 sheets | Remarks |
|---|---|---|---|---|---|---|---|
| 14 | L-20 | 0.01 | 32 | 110 | 10 | 16 | Comp. |
| 15 | L-20 | 0.2 | 32 | 75 | 9 | 0 | Inv. |
| 16 | L-20 | 0.8 | 32 | 25 | 4 | 10 | Comp. |
| 17 | L-37 | 0.01 | 15 | 110 | 10 | 14 | Comp. |
| 18 | L-37 | 0.3 | 15 | 70 | 9 | 0 | Inv. |
| 19 | L-37 | 0.5 | 15 | 40 | 9 | 0 | Inv. |
| 20 | L-37 | 0.8 | 15 | 20 | 5 | 8 | Comp. |

Comp: Comparison;
Inv.: Invention

In this experiment, as a comparative polymer latex (a), Vilonal MD1250 (Tg=62° C., produced by Toyo Boseki Co.) was employed.

Example 2

An experiment was conducted in the same manner as that employed for conducting Experiment 1 except that a polymer contained in a surface protective layer was eliminated contained in other layers. The obtained results are shown Table 2.

TABLE 2

| Sample No. | Polymer latex | Layer containing polymer latex | Amount ratio P/B | Tg ° C. | ST g | Roller marks | Transportation failure number/100 sheets | Remarks |
|---|---|---|---|---|---|---|---|---|
| 21 | L-20 | Photosensitive | 0.01 | 32 | 115 | 5 | 7 | Comparison |
| 22 | L-20 | Photosensitive layer | 0.2 | 32 | 75 | 9 | 0 | Invention |
| 23 | L-20 | Backing layer | 0.01 | 32 | 110 | 4 | 7 | Comparison |
| 24 | L-20 | Backing layer | 0.2 | 32 | 70 | 9 | 0 | Invention |

Example 3

Samples were produced in the same way as that employed producing the samples in Example 1, except that surface protective layer coating solution 1 was replaced with surface protective layer coating solution 2, and the same evaluation as that employed in Example 1 was conducted. In this example, γ represents a tangent obtained between a density of 1.0 and a density of 2.5 of the characteristic curve of an image, which is obtained by exposing the photosensitive material through a step wedge to a semiconductor laser capable of generating a 710 nm laser light and by thermally developing the thus exposed photosensitive material at 110° C. for 15 sec.

Surface Protective Layer Coating Solution 2

| | |
|---|---|
| Acetone | 5 ml/m$^2$ |
| Methylethyl ketone | 21 ml/m$^2$ |
| Polymer latex | weight as shown in Table 2 |
| Hydrazine compound (shown in Table 2) | 15 mg/m$^2$ |
| Compound: P-22 | 10 mg/m$^2$ |

-continued

| | |
|---|---|
| Cellulose acetatebutylate | 2.3 g/m$^2$ |
| Methanol | 7 ml/m$^2$ |
| Phthalazine | 250 mg/m$^2$ |
| $CH_2=CHSO_2CH_2CH_2OCH_2CH_2SO_2CH=CH_2$ | 35 mg/m$^2$ |
| $C_9H_{17}O-C_6H_4-SO_3Na$ | 0.5 mg/m$^2$ |

Further also employed as a matting agent, was combined usage of 10 mg/m$^2$ of monodispersed silica particles having a monodispersibility of 10% and an average particle size of 3 μm, with 20 mg/M$^2$ of spherical PMMA particles having an average particle size of 5 μm.

The obtained results are shown in Table 3.

TABLE 3

| Sample No. | Polymer latex | Amount ratio P/B | Tg ° C. | Hydrazine compound | ST g | Roller marks | γ | Transportation failure number/100 sheets | Remarks |
|---|---|---|---|---|---|---|---|---|---|
| 25 | — | | | | 120 | 8 | 4.0 | 20 | Comp. |
| 26 | — | | | H-7 | 115 | 7 | 8.0 | 21 | Comp. |
| 27 | Comp.(a) | 0.3 | | | 120 | 8 | 3.9 | 19 | Comp. |
| 28 | Comp.(a) | 0.3 | | H-7 | 115 | 7 | 7.6 | 21 | Comp. |
| 29 | L-5 | 0.3 | −11 | | 55 | 10 | 4.5 | 0 | Inv. |
| 30 | L-5 | 0.3 | −11 | H-7 | 50 | 10 | 8.9 | 0 | Inv. |
| 31 | L-5 | 0.3 | −11 | H-12 | 60 | 10 | 9.1 | 0 | Inv. |
| 32 | L-34 | 0.2 | 21 | | 50 | 10 | 9.1 | 0 | Inv. |
| 33 | L-34 | 0.2 | 21 | H-7 | 45 | 10 | 9.4 | 0 | Inv. |
| 34 | L-34 | 0.2 | 21 | H-12 | 45 | 18 | 9.5 | 0 | Inv. |

Comp.: Comparison;
Inv.: Invention

According to the present invention, a thermally developable photosensitive material with an excellent transportation ability and no roller mark can be obtained.

Example 4

PET pellets, of which Tg was lowered employing terephthalic acid, ethylene glycol, and butylene glycol, were prepared in place of PET pellets employed in Example 1. Tg of each example is shown in Table 4. Producing a PET support from the PET pellets was conducted in the same manner as that employed for producing the PET support in Example 1 except at thickness of the support was 120 μm. Further, an experiment was conducted in the same manner as that employed conducting an experiment in Example 1, except that the kind of the support was different from the kind of the support employed in Example 1, and a polymer latex was not contained in a surface protective layer employed in Example 1. The obtained results are shown in Table 4.

TABLE 4

| Sample No. | Tg of support ° C. | ST g | Roller marks | Transportation failure number/100 sheets | Remarks |
|---|---|---|---|---|---|
| 35 | 79 | 115 | 8 | 19 | Comparison |
| 36 | 70 | 80 | 9 | 3 | Invention |
| 37 | 61 | 50 | 9 | 2 | Invention |
| 38 | 50 | 40 | 9 | 3 | Invention |

Example 5

Preparation of Silver Halide Grains

In 900 ml of water, 7.5 g of inert gelatin and 10 mg of potassium bromide were dissolved. After adjusting the temperature to 35 ° C. and the pH to 3.0, to the thus obtained solution were added 370 ml of an aqueous solution containing 74 g of silver nitrate, and an aqueous solution containing potassium bromide and potassium iodide in a mole ratio of 96/4 over a period of 10 min. employing a controlled double-jet method while maintaining the pAg at 7.7. Subsequently, 0.3 g of 4-hydroxy-6-methyl-1,3,3a,7-tetraazaindene was added and the pH was adjusted to 5 using NaOH. Thus, obtained was cubic silver iodobromide grains having an average grain size of 0.06 μm, a projection diameter area variation coefficient of 8 percent, and a [100] plane ratio of 86 percent. The resulting emulsion was subjected to desalting through coagulation precipitation employing an coagulant. After that, 0.1 g of phenoxyethanol was added, and the pH and pAg were adjusted to 5.9 and 7.5 respectively. To the thus obtained solution were added sensitizing dye, SD-1 in an amount of $5\times10^{-5}$ mol/mol of silver halide, and sensitizing dye, SD-2 in an amount of $5\times10^{-5}$ mol/mol of silver halide, after which the thus obtained solution was heated to 60° C. and to said solution was added 2 mg of sodium thiosulfate. The thus obtained solution was stirred for an additional 100 min., after which said solution was cooled to 38° C. so that chemical ripening was terminated and silver halide grains were obtained.

Preparation of Organic Fatty Acid Silver Emulsion 300 ml of water containing 10.6 g of behenic acid was heated up to 90° C. to dissolve the behenic acid. While sufficiently being stirred, to the thus obtained solution was added 31.1 ml of 1N NaOH, and the solution was then stirred for an additional hour, after which the solution was cooled down to 30° C. While being stirred sufficiently, to the solution were added 7.0 ml of 1N phosphoric acid and 0.01 g of N-bromosuccinic acid imide. After that, while being stirred upon heating at 40° C., to the thus obtained solution were added previously prepared silver halide grains in an amount of 10 mol% to silver behenate in terms of silver amount. To the above obtained solution was continuously added 25 ml of 1N silver nitrate aqueous solution for 2 minutes and thus obtained solution was stirred for an additional hour.

To the thus obtained emulsion was added polyvinylbutyral dissolved in ethyl acetate. The emulsion was sufficiently stirred and allowed to be undisturbed so that ethyl acetate phase containing the silver behenate and the silver halide grains was separated from water phase. After the water phase was removed, the silver behenate and the silver halide grains were collected employing a centrifuge. After that, to the thus obtained silver behenate and silver halide grains were added 20 g of synthesized Zeorite A-3 (spherical form, produced by Toso Co.) and 22 ml of isopropyl alcohol and the thus obtained mixture was allowed to be undisturbed for 1 hour and then filtered. Furthermore, to the thus obtained mixture were added 3.4 g of polyvinyl butyral and 23 ml of isopropyl alcohol and the resulting mixture was sufficiently stirred at rapid rotational rate and dispersed so that the preparation of an organic fatty acid silver emulsion was completed.

| (Photosensitive layer composition) | |
|---|---|
| Organic fatty acid silver emulsion (in terms of silver amount) | 1.75 g/m$^2$ |
| Pyridiumhydrobromideperbromide | $1.5 \times 10^{-4}$ mol/m$^2$ |
| Potassium bromide | $1.8 \times 10^{-4}$ mol/m$^2$ |
| 2-(4-chlorobenzoyl)benzoic acid | $1.5 \times 10^{-3}$ mol/m$^2$ |
| Sensitizing dye SD-3 | $4.2 \times 10^{-6}$ mol/m$^2$ |
| 2-mercaptobenzimidazole | $3.2 \times 10^{-3}$ mol/m$^2$ |
| 2-tribromomethylsulfonylquinoline | $6.0 \times 10^{-4}$ mol/m$^2$ |
| Hydrazine compound 1-1 | $1.5 \times 10^{-3}$ mol/m$^2$ |

As solvents, methyl ethyl ketone, acetone and methanol were suitably used.

| (Surface protective layer composition) | |
|---|---|
| Cellulose acetate | 4 g/m$^2$ |
| 1,1-bis (2-hydroxy-3,5-dimethylphenyl)-3,5,5-trimethylhexane | $4.8 \times 10^{-3}$ mol/m$^2$ |
| Phthalazine | $3.2 \times 10^{-3}$ mol/m$^2$ |
| 4-methyl-phthalic acid | $1.6 \times 10^{-3}$ mol/m$^2$ |
| Tetra-chlorophthalic acid | $7.9 \times 10^{-4}$ mol/m$^2$ |
| Tetra-chlorophthalic acid anhydride | $9.1 \times 10^{-4}$ mol/m$^2$ |
| Silicon dioxide (particle size: 2 $\mu$m) | 0.22 g/m$^2$ |

As solvents, methyl ethyl ketone, acetone and methanol were suitably used.

| (Backing layer composition) | |
|---|---|
| Cellulose acetate | 4 g/m$^2$ |
| Antihalation dye-A | 0.06 g/m$^2$ |
| Antihalation dye-B | 0.018 g/m$^2$ |

As solvents, methyl ethyl ketone, acetone and methanol were suitably used.

Non-photosensitive Layer Consisting of a Water-soluble Polymer

| | |
|---|---|
| Polyvinyl alcohol | 20 mg/m$^2$ |
| Ammonium sulfate | 5 mg/m$^2$ |
| Silicon dioxide (particle size: 10 $\mu$m) | 50 mg/m$^2$ |

Sensitizing dye SD-1

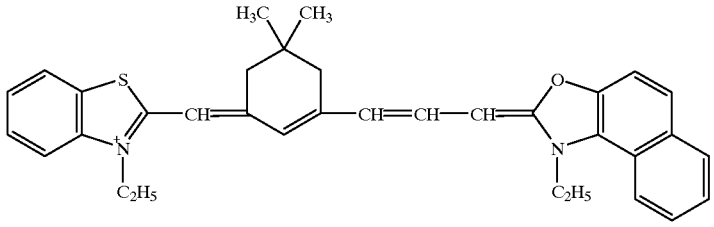

Sensitizing dye SD-2

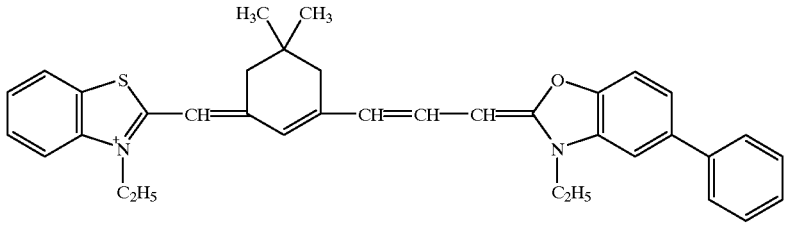

Sensitizing dye SD-3

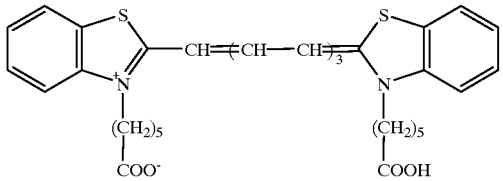

Antihalation dye-A

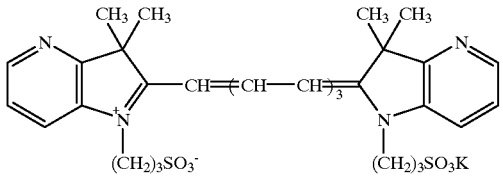

-continued

Antihalation dye-B

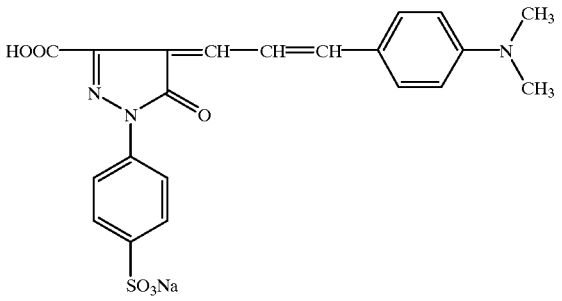

Onto biaxially stretched polyethyleneterephthalate (PET) films were coated previously mentioned compositions to obtain shown in Table 5 so that each sample had characteristics shown in Tables 5, 6 and 7. In the present a non-photosensitive layer consisting of a water polymer was applied between a support and a backing layer.

Evaluation of Cutter Failure

Cutter failures were evaluated by cutting 20,000 sheets of each sample under the conditions of 23° C. and 48% RH employing a plotter produced by NEC Co. The numbers of the cutter failures are shown in Table 5.

Results obtained by varying breaking stress are shown in Table 5, and results obtained by varying the breaking elongation are shown in Table 6, while results obtained by varying the Young's modulus are shown in Tables 7.

TABLE 5

| Sample No. | Thickness of PET base μm | Breaking stress kgf/mm$^2$ | Cutter failures number/ 20,000 | ST g | Remarks |
|---|---|---|---|---|---|
| 39 | 130 | 50 | 100 | 130 | Comparison |
| 40 | 95 | 13 | 0 | 80 | Invention |
| 41 | 90 | 11 | 0 | 75 | Invention |

TABLE 6

| Sample No. | Thickness of PET base μm | Breaking elongation % | Cutter failures number/ 20,000 | ST g | Remarks |
|---|---|---|---|---|---|
| 42 | 135 | 400 | 200 | 140 | Comparison |
| 43 | 95 | 130 | 0 | 80 | Invention |
| 44 | 90 | 110 | 0 | 75 | Invention |

TABLE 7

| | Thickness of PET base μm | Young's modulus kgf/mm$^2$ | Cutter failures number/ 20,000 | ST g | Remarks |
|---|---|---|---|---|---|
| 45 | 140 | 800 | 200 | 150 | Comparison |
| 46 | 95 | 330 | 0 | 80 | Invention |
| 47 | 90 | 310 | 0 | 75 | Invention |

As proved in the present inventive examples, according to the methods described in the present invention, highly improved prevention of the cutter failures can be achieved, when the roll type thermally developable material is cut in an exposing apparatus.

Disclosed embodiment can be varied by a skilled person without departing from the spirit and scope of the invention

What is claimed is:

1. A thermally developable material comprising a support, an image forming layer comprising an organic silver salt and provided on a side of the support, and a component layer provided on the same side of the support as said image forming layer provided, wherein the stiffness (ST) of said thermally developable material under conditions of 23° C. and 50% RH is 30 g≦ST≦80 g; and wherein said thermally developable material comprises a polymer latex having a glass transition temperature lower than 50° C.

2. The thermally developable material of claim 1, wherein said image forming layer or said component layer comprises a reducing agent or a precursor of said reducing agent.

3. The thermally developable material of claim 1, wherein said image forming layer comprises silver halide grains, and said thermally developable material is a thermally developable photosensitive material.

4. The thermally developable material of claim 1, wherein said thermally developable material comprises a hydrazine derivative.

5. The thermally developable material of claim 1, wherein the breaking stress of said thermally developable material is from 10 to 30 kgf/mm$^2$.

6. The thermally developable material of claim 1, wherein the breaking elongation of said thermally developable material is from 100 to 300%.

7. The thermally developable material of claim 1, wherein the Young's modulus of said thermally developable material is from 300 to 600 kgf/mm$^2$.

8. The thermally developable material of claim 1, wherein said thermally developable material is a roll type thermally developable material.

9. The thermally developable material of claim 1, wherein the thickness of said support is from 50 to 300 μm.

10. The thermally developable material of claim 1, wherein the thickness of said support is from 70 to 180 μm.

11. The thermally developable material of claim 1, wherein the thickness of said support is from 110 to 140 μm.

12. The thermally developable material of claim 1, wherein the glass transition temperature of said support is from 50° C. to 70° C.

* * * * *